US007038645B2

(12) United States Patent
Ozawa et al.

(10) Patent No.: US 7,038,645 B2
(45) Date of Patent: May 2, 2006

(54) DRIVING METHOD FOR ELECTRO-OPTICAL APPARATUS, DRIVING CIRCUIT THEREFOR, ELECTRO-OPTICAL APPARATUS, AND ELECTRONIC EQUIPMENT

(75) Inventors: Tokuro Ozawa, Suwa (JP); Hideto Ishiguro, Shiojiri (JP); Yojiro Matsueda, Chino (JP)

(73) Assignee: Seiko Epson Corporation, Tokyo (JP)

( * ) Notice: Subject to any disclaimer, the term of this patent is extended or adjusted under 35 U.S.C. 154(b) by 1149 days.

(21) Appl. No.: 09/902,269

(22) Filed: Jul. 11, 2001

(65) Prior Publication Data

US 2002/0018056 A1 Feb. 14, 2002

(30) Foreign Application Priority Data

Jul. 24, 2000 (JP) ..... 2000-222577

(51) Int. Cl.
*G09G 3/36* (2006.01)

(52) U.S. Cl. ..... 345/89; 345/103; 345/690

(58) Field of Classification Search ..... 345/87, 345/89, 94, 98–100, 690, 103
See application file for complete search history.

(56) References Cited

U.S. PATENT DOCUMENTS 5,793,345 A * 8/1998 Silverbrook ..... 345/89
5,920,299 A * 7/1999 Ohshima et al. ..... 345/88
5,963,190 A * 10/1999 Tsuboyama et al. ..... 345/103
6,002,385 A * 12/1999 Silverbrook ..... 345/100
6,094,187 A * 7/2000 Jones et al. ..... 345/690

FOREIGN PATENT DOCUMENTS

WO WO9942983 * 8/1999

* cited by examiner

*Primary Examiner*—Regina Liang
(74) *Attorney, Agent, or Firm*—Oliff & Berridge, PLC

(57) ABSTRACT

The invention obtains high-quality display by suppressing display unevenness. Sub-pixels are disposed correspondingly to each set of the intersections between 3m pairs of paired scanning lines, which are formed in such a manner as to extend in the X-direction, and n pairs of paired data lines, which are a digital data line and an analog data line and extend in the Y-direction. Further, a set of sub-pixels consecutively arranged in the Y-direction is driven as one pixel. In this case, in a first mode, each of the sub-pixels of one pixel turns on or off according to gradation data representing the gradation level of this pixel. Further, in a second mode, a voltage signal representing the gradation level of this pixel is applied to the sub-pixels of one pixel. Furthermore, in a first case of the second mode, the voltage signals are supplied by the first data line driving circuit in line sequence. Moreover, in a second case of the second mode, voltage signals are supplied by a second data line driving circuit in point sequence.

14 Claims, 24 Drawing Sheets

(a)
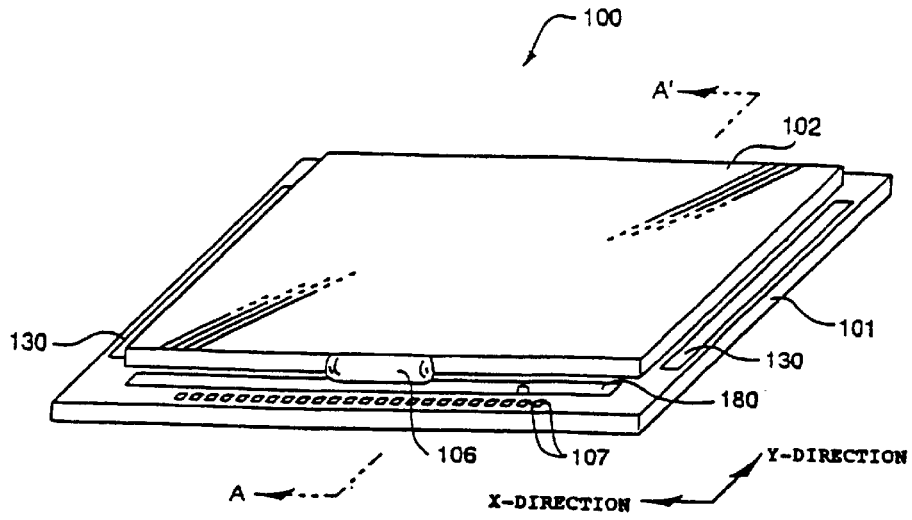
(b)
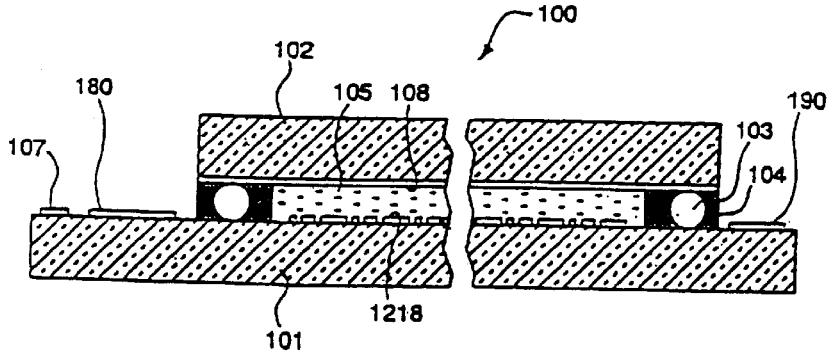
[FIG. 1]

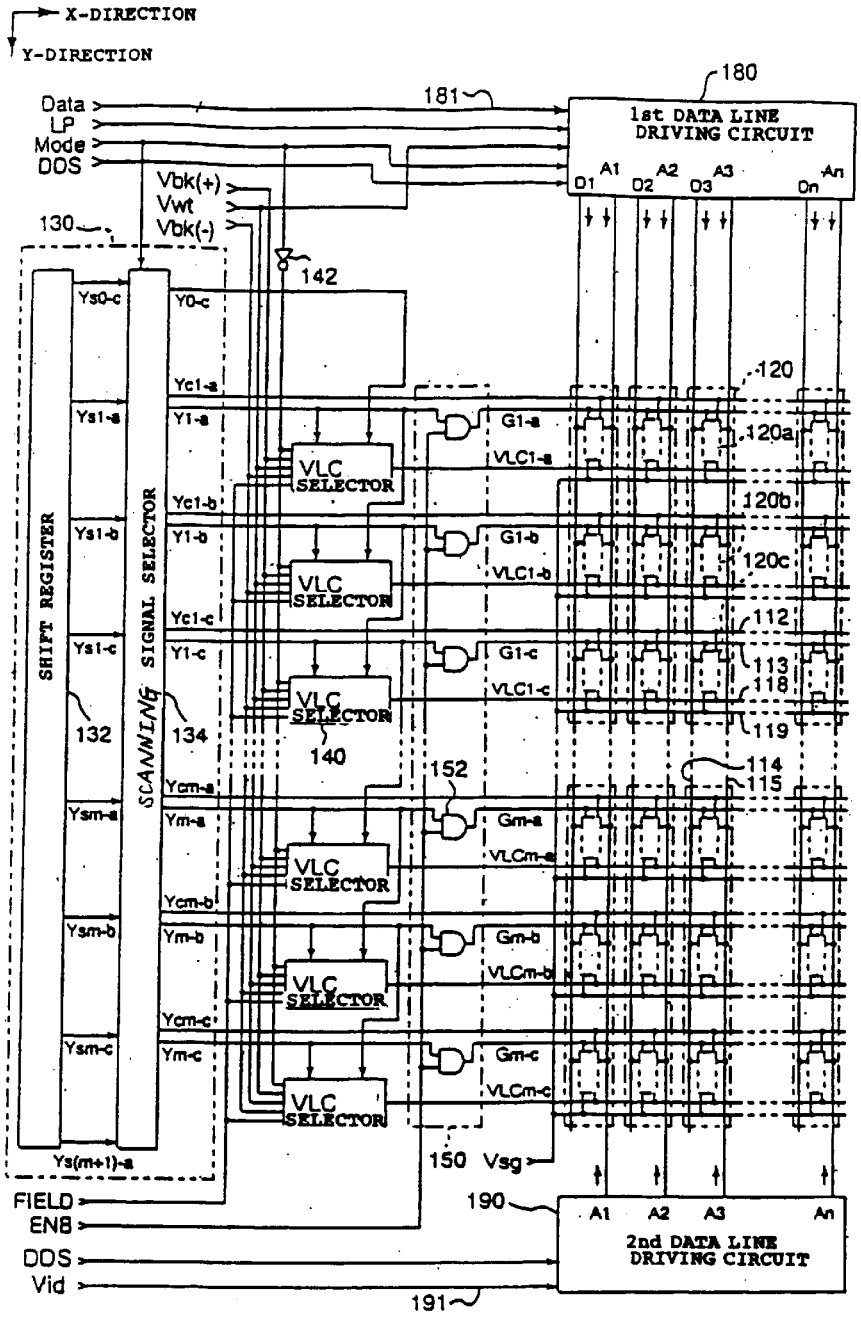
[FIG. 21]

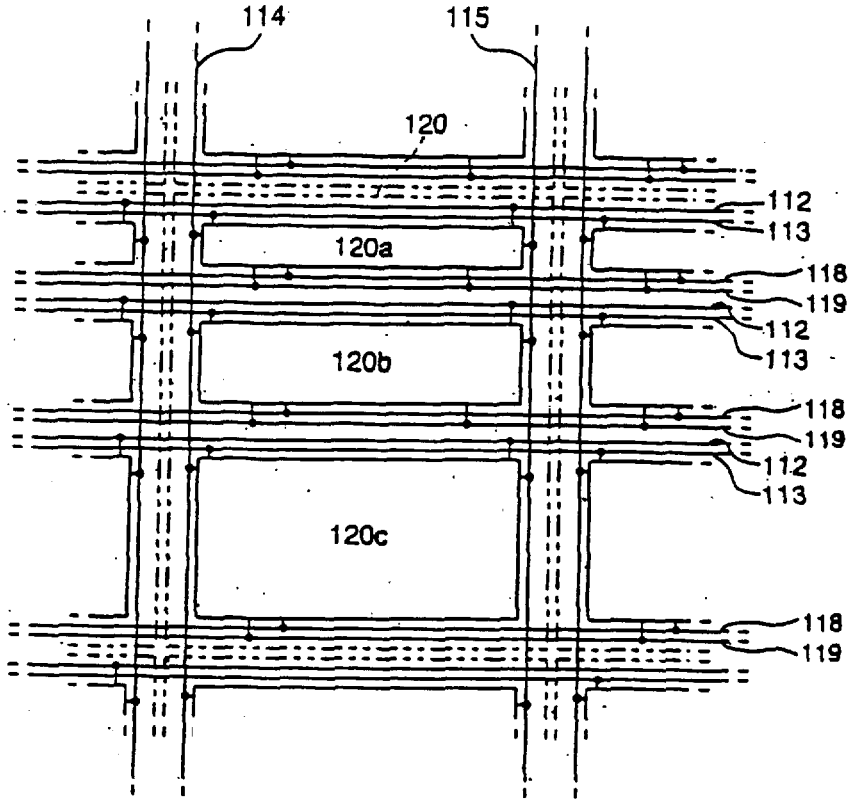
[FIG. 3]

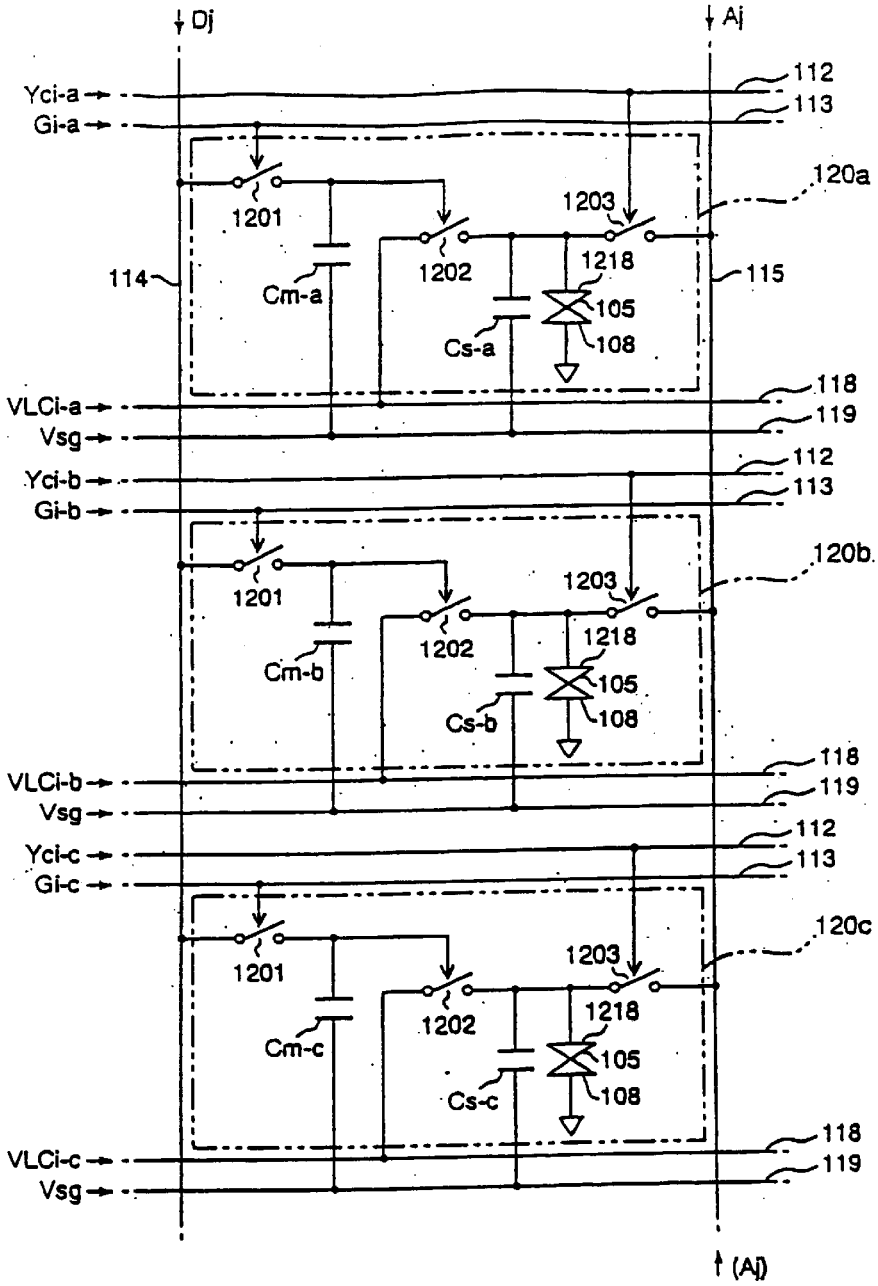
[FIG. 4]

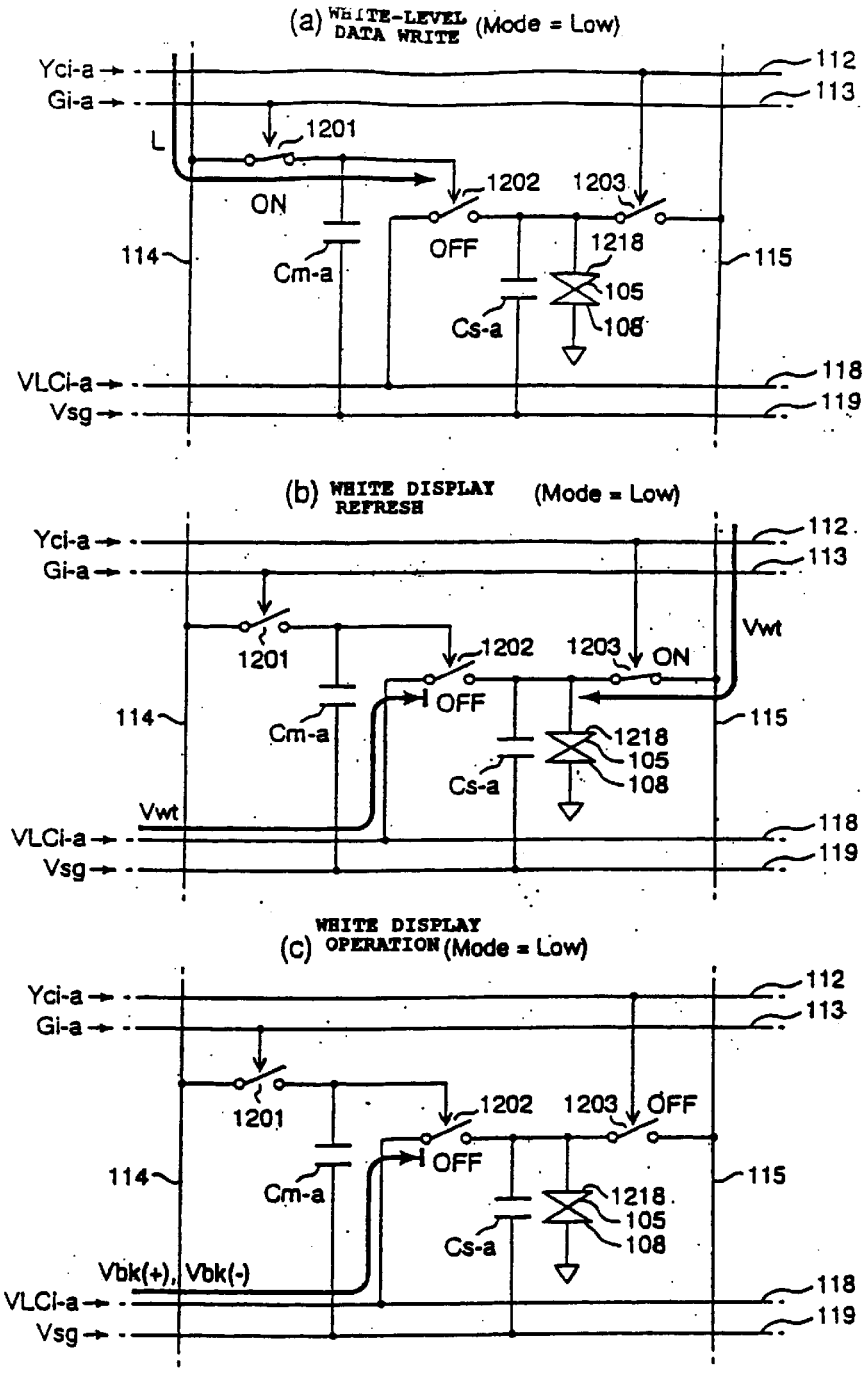
[FIG. 5]

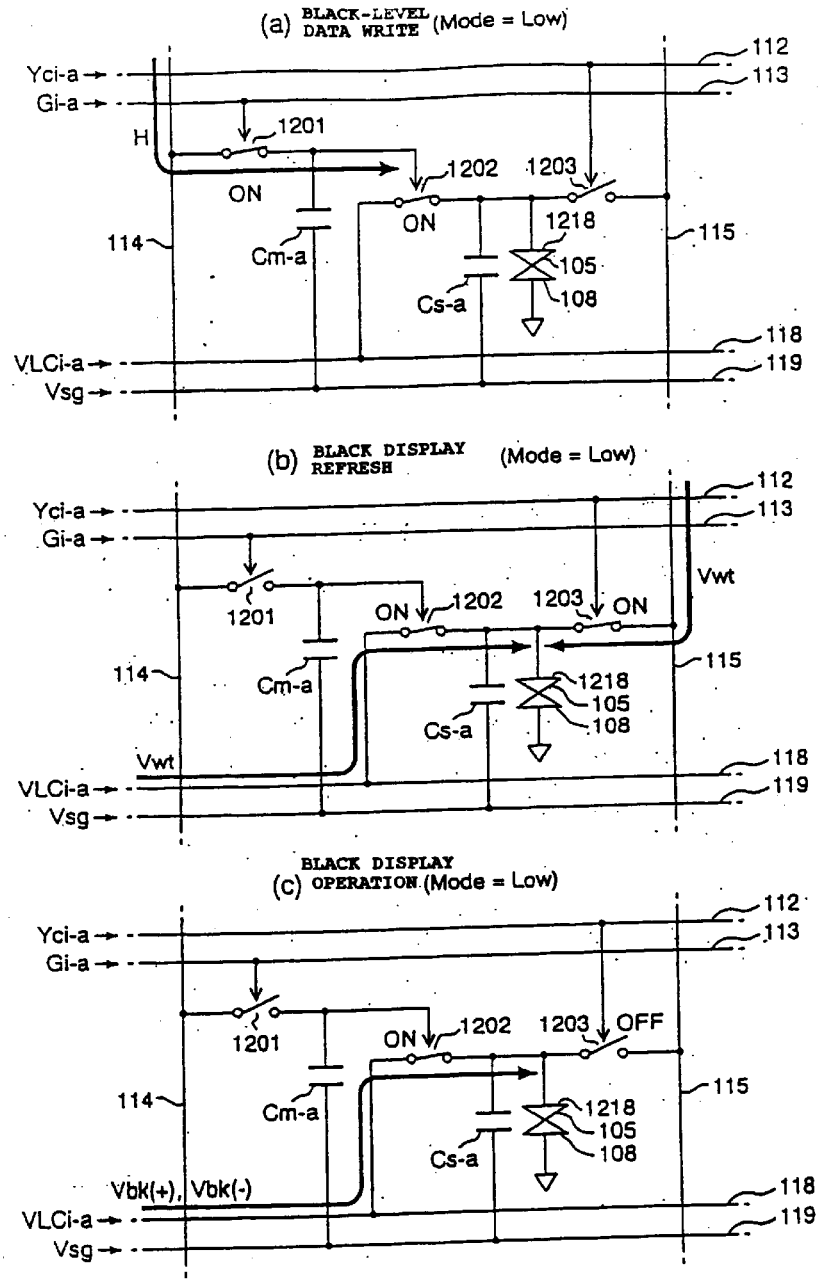
[FIG. 6]

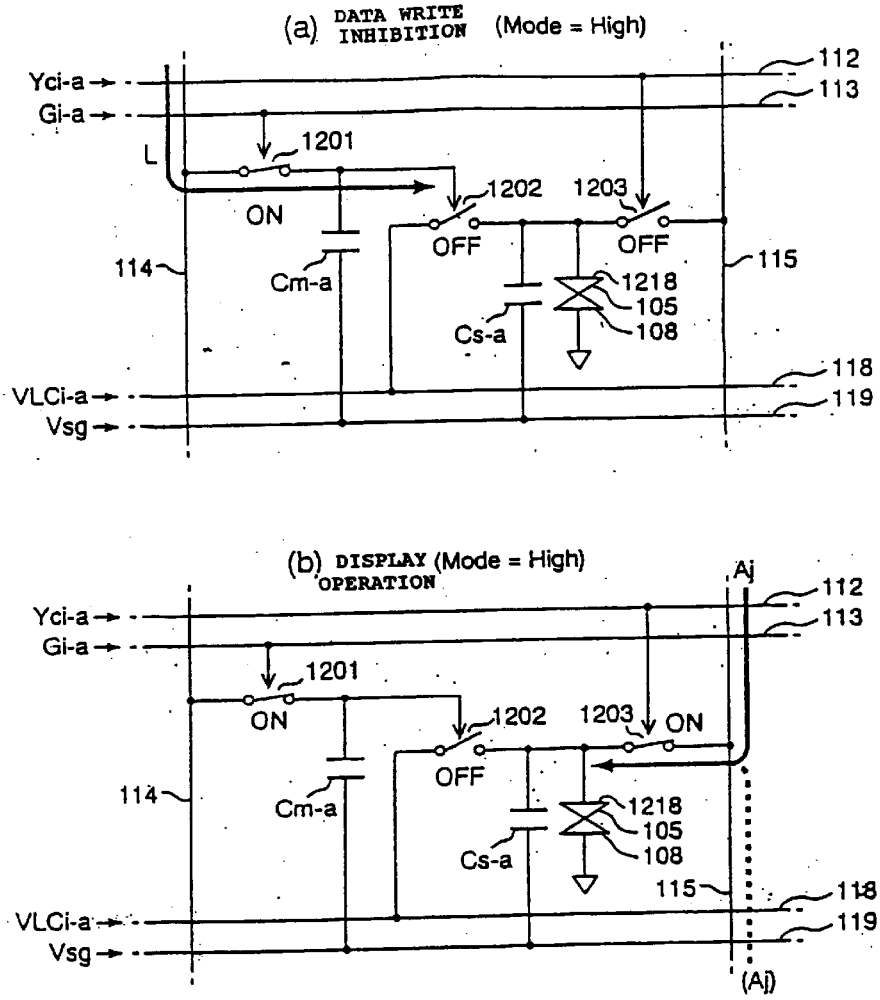
[FIG. 7]

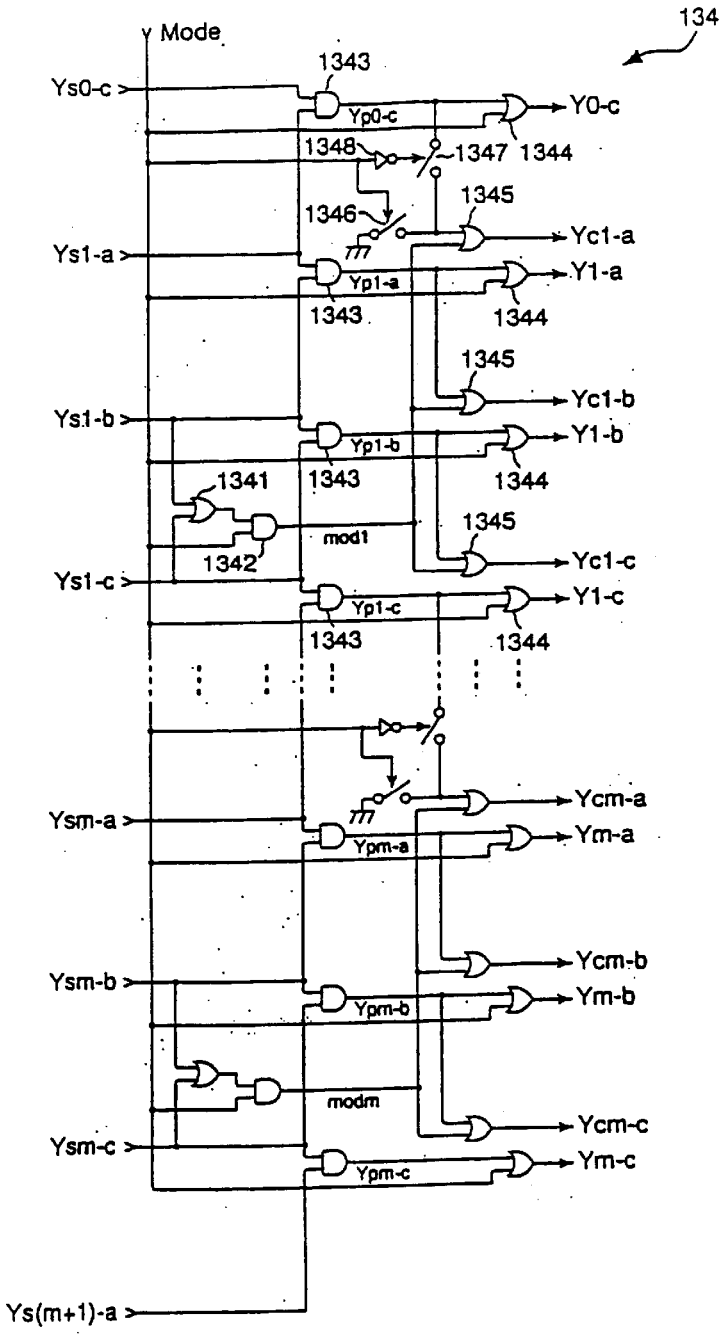
[FIG. 8]

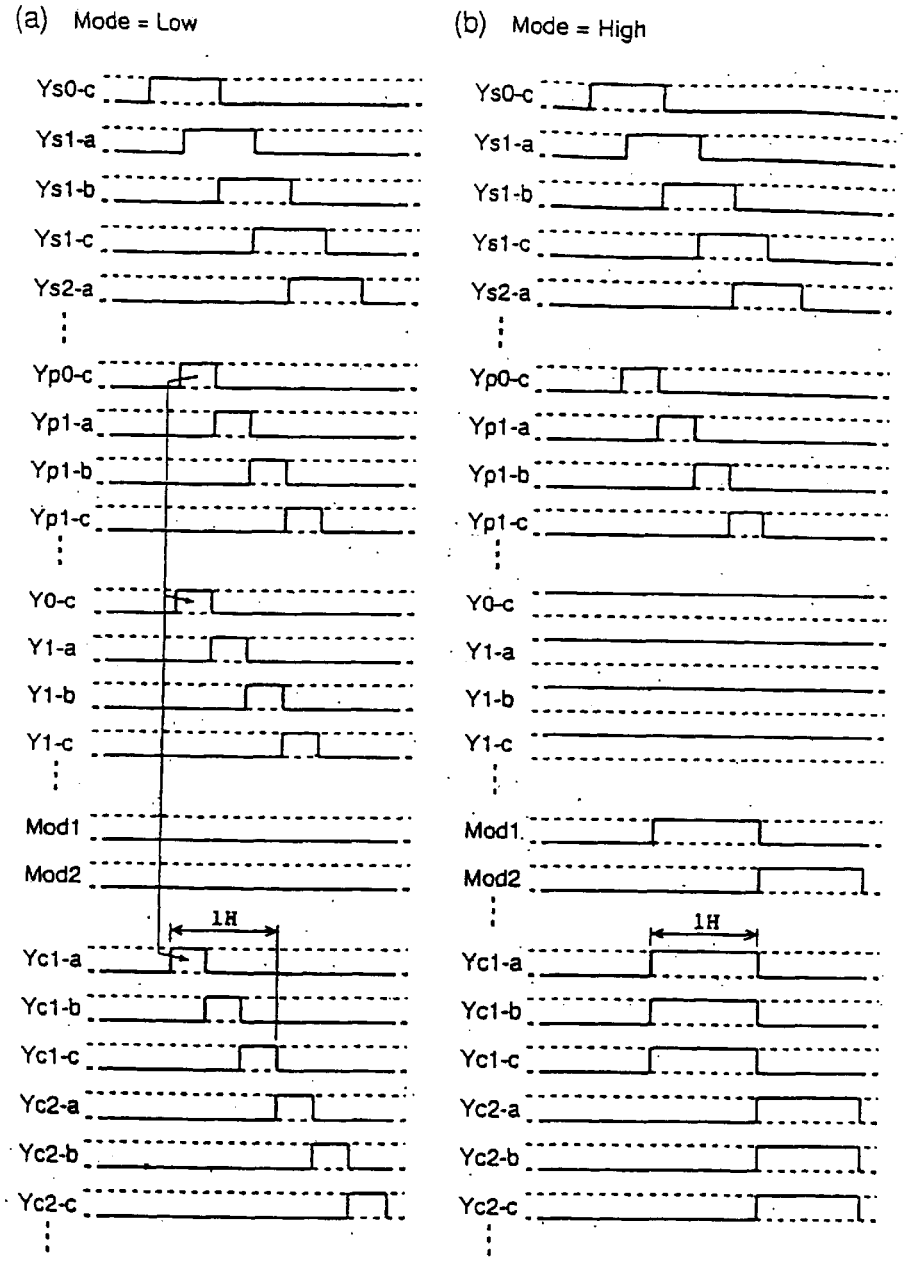
[FIG. 9]

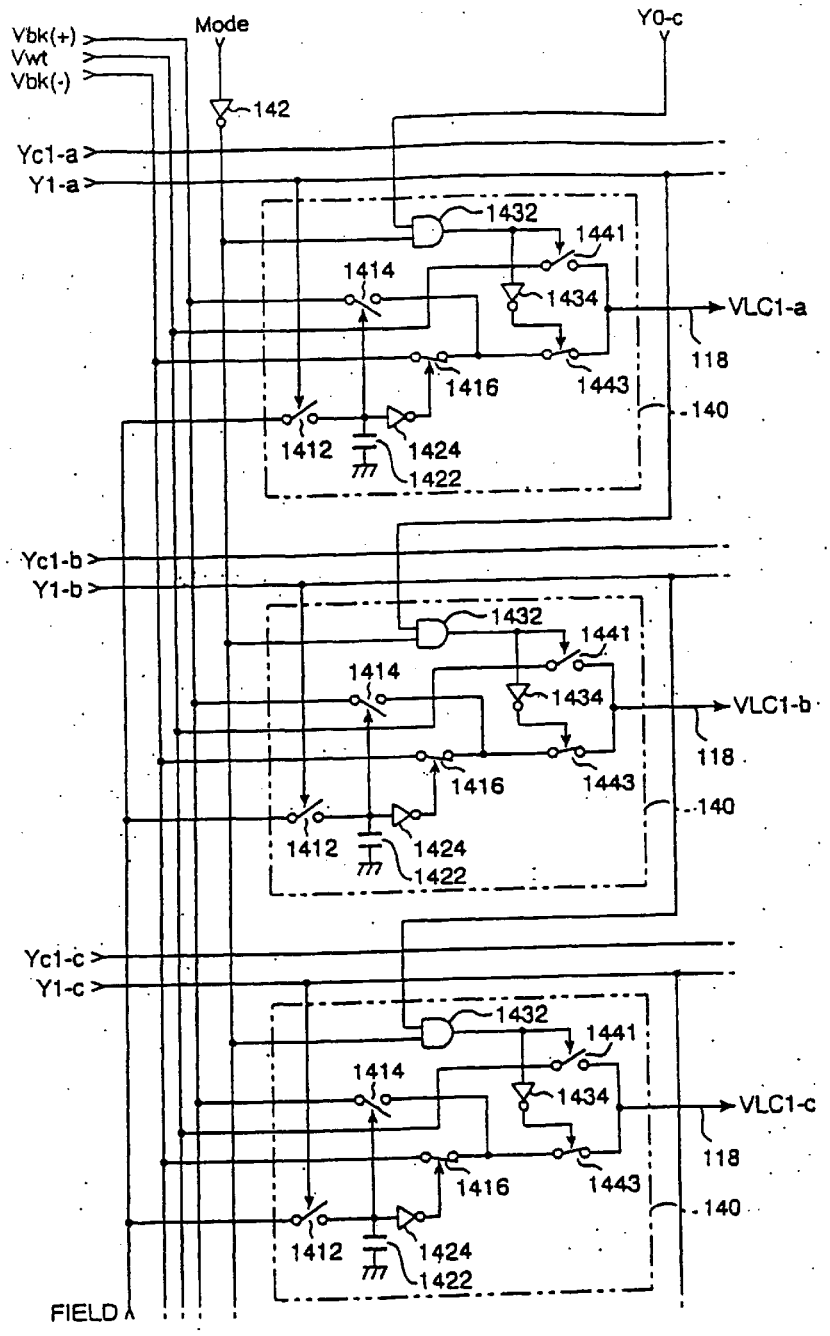
F DOCUME
[FIG. 10]

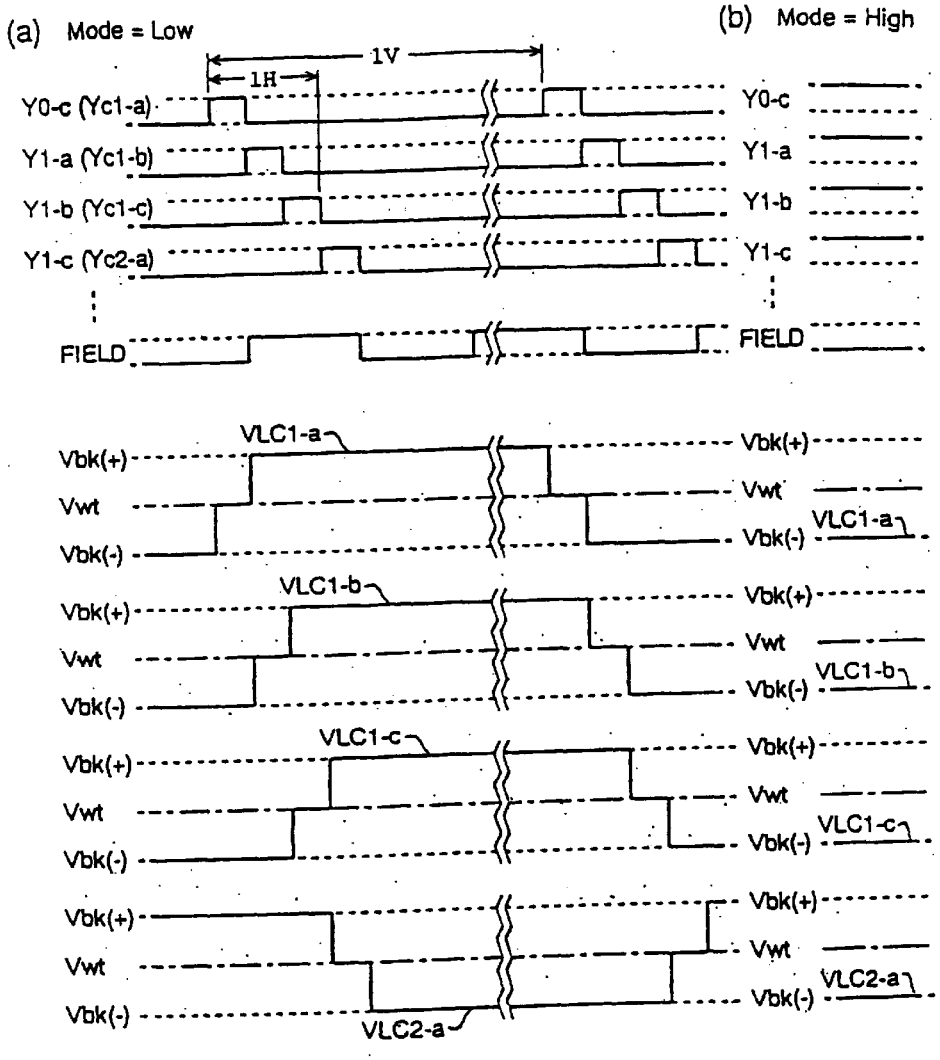
[FIG. 11]

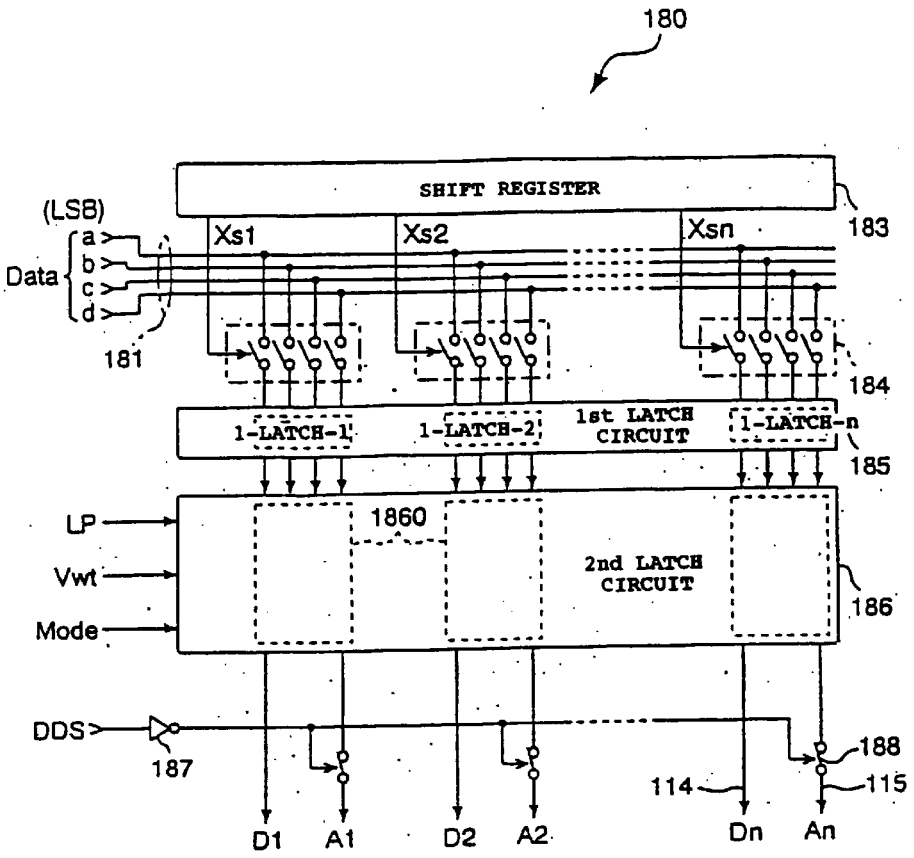
[FIG. 12]

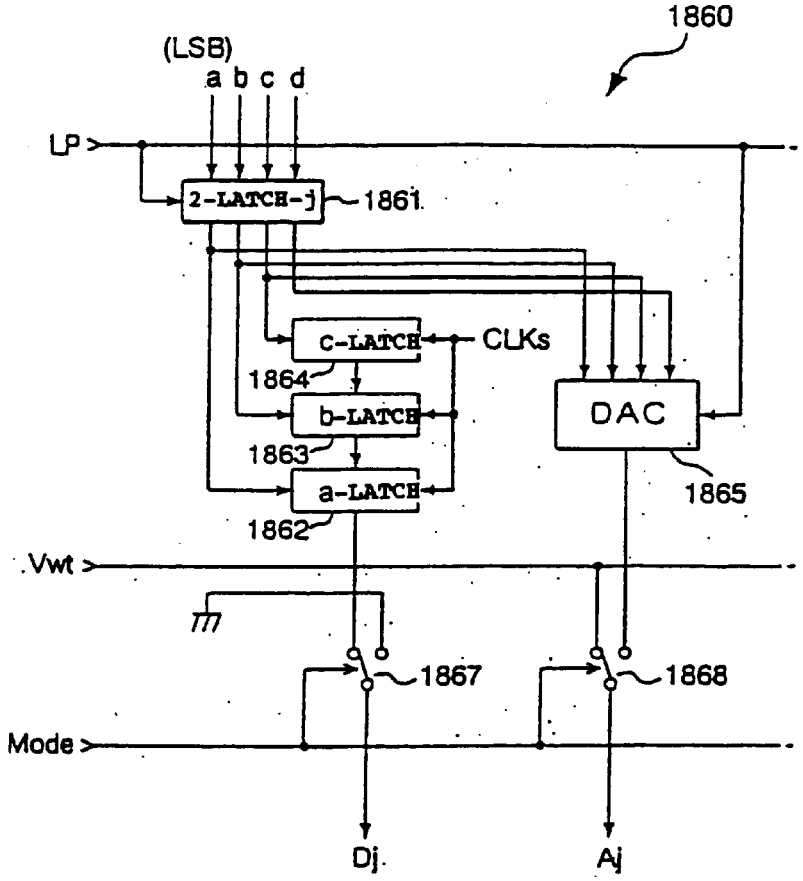
[FIG. 13]

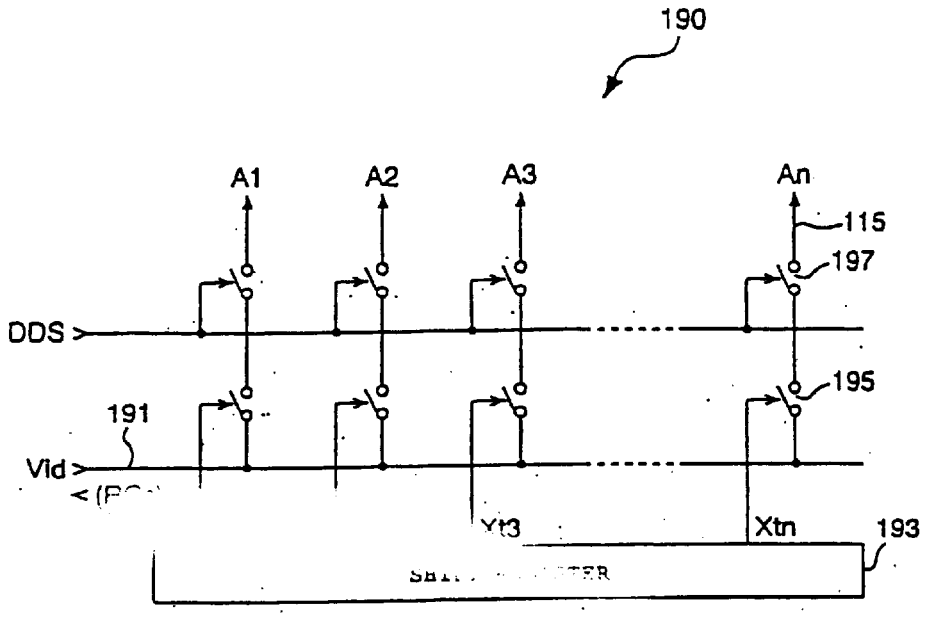
[FIG. 14]

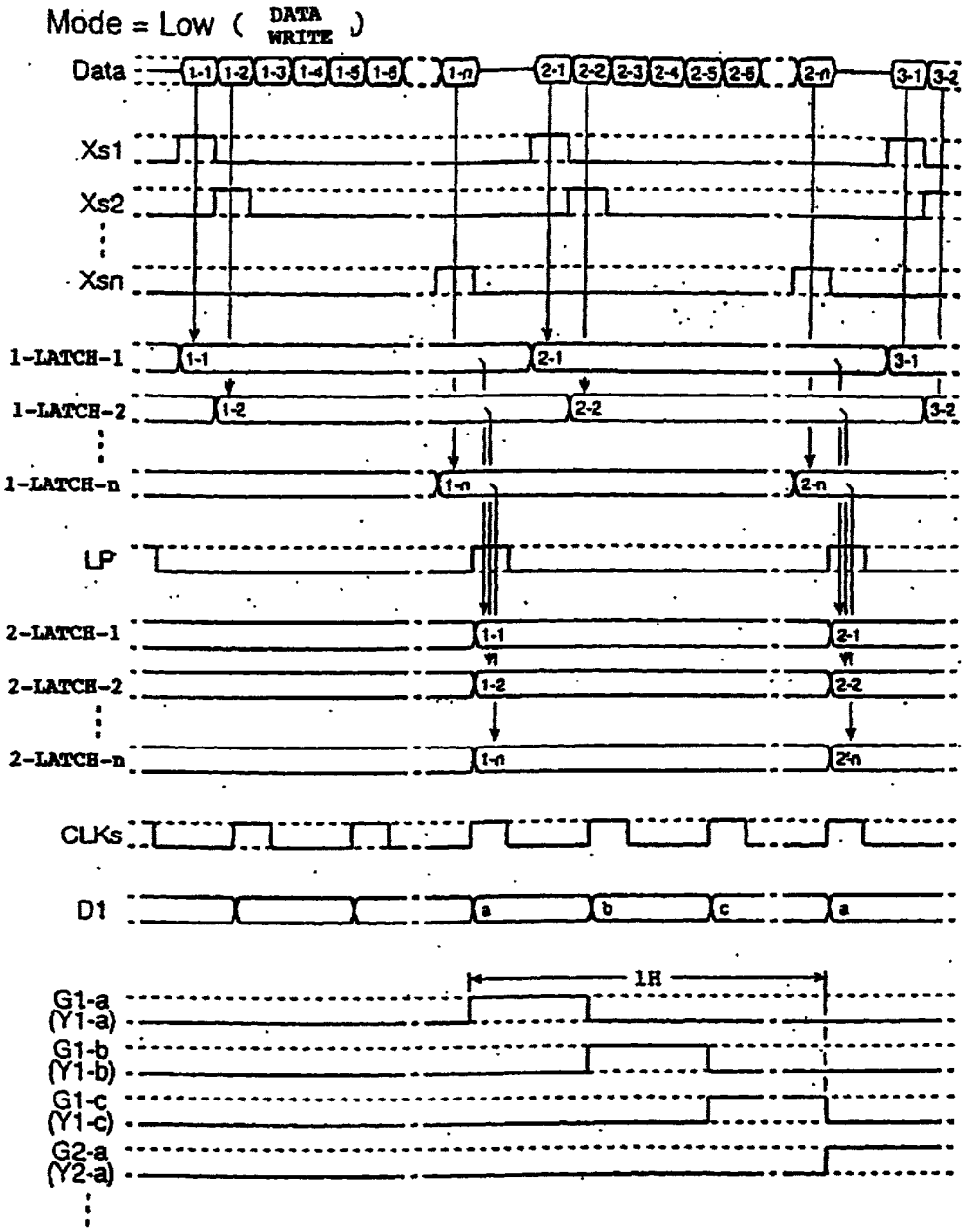
[FIG. 15]

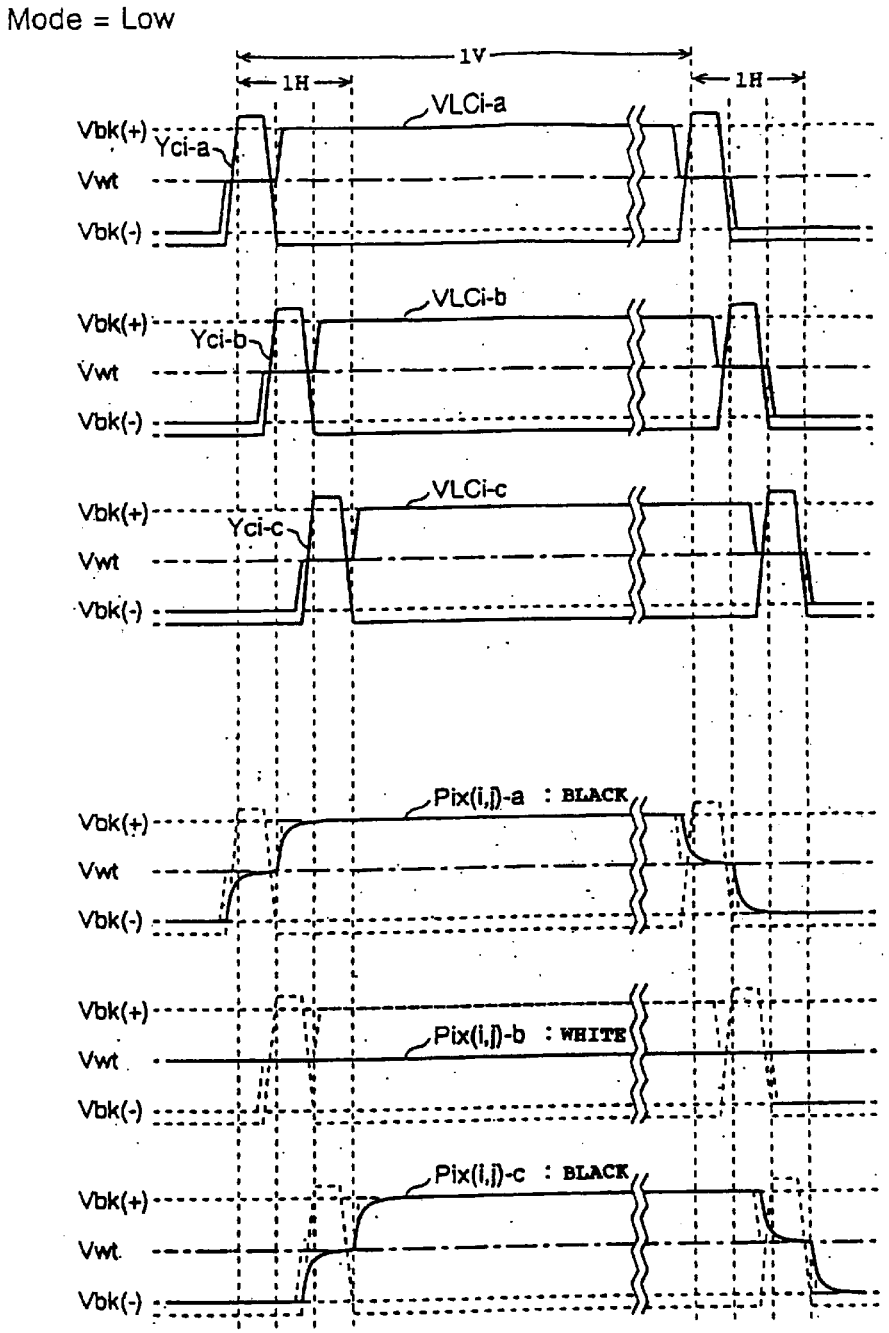
[FIG. 16]

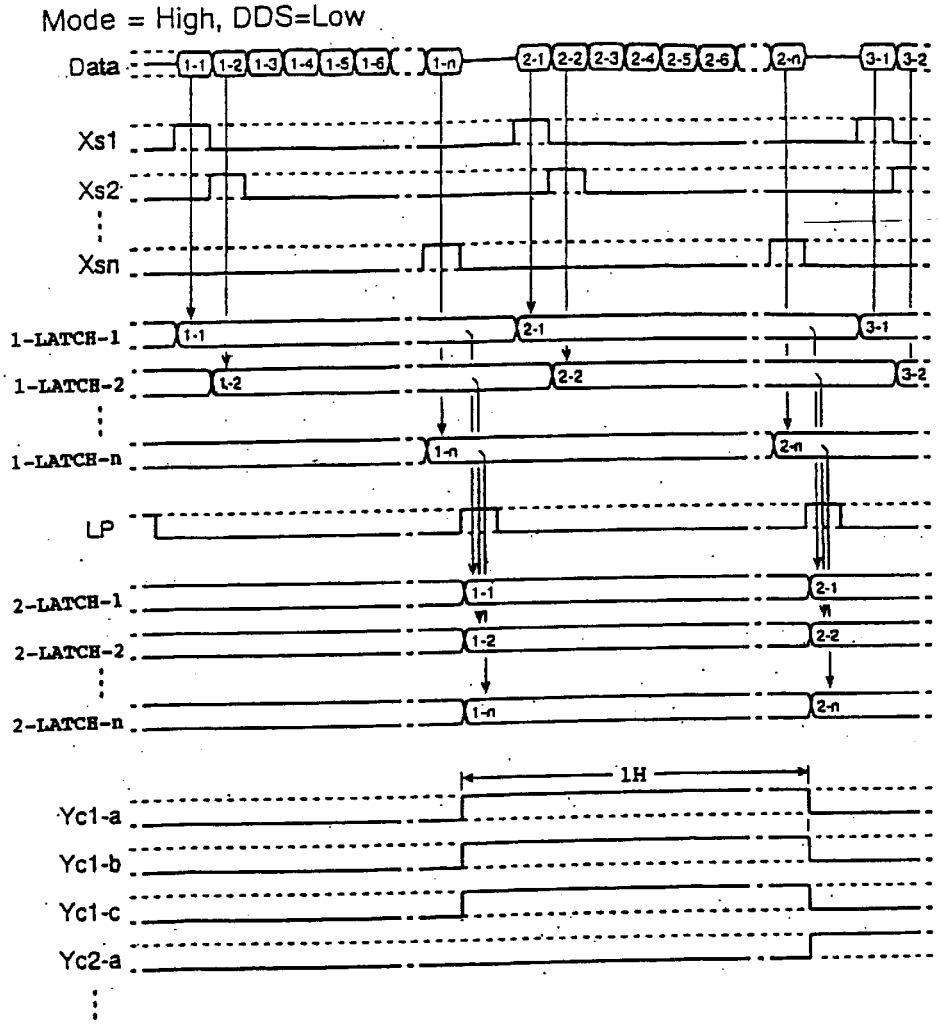
[FIG. 17]

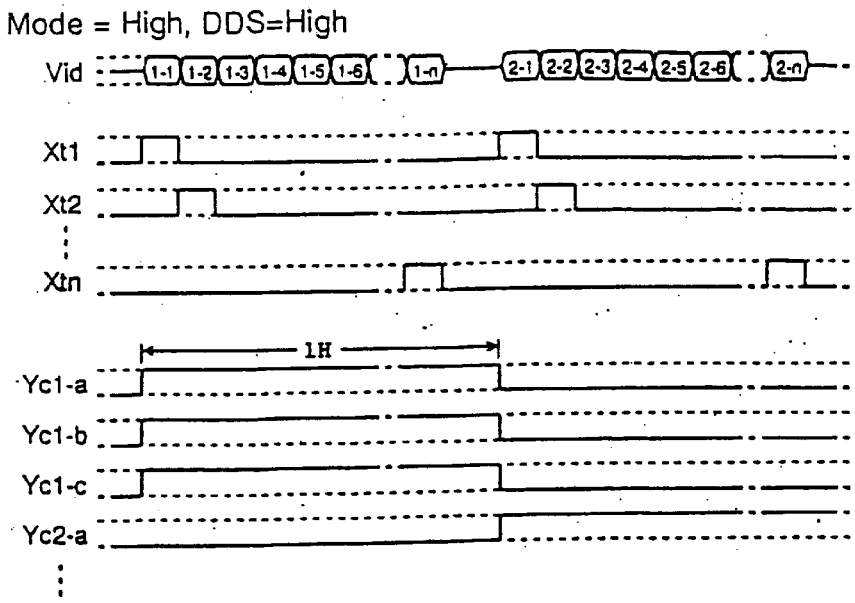
[FIG. 18]

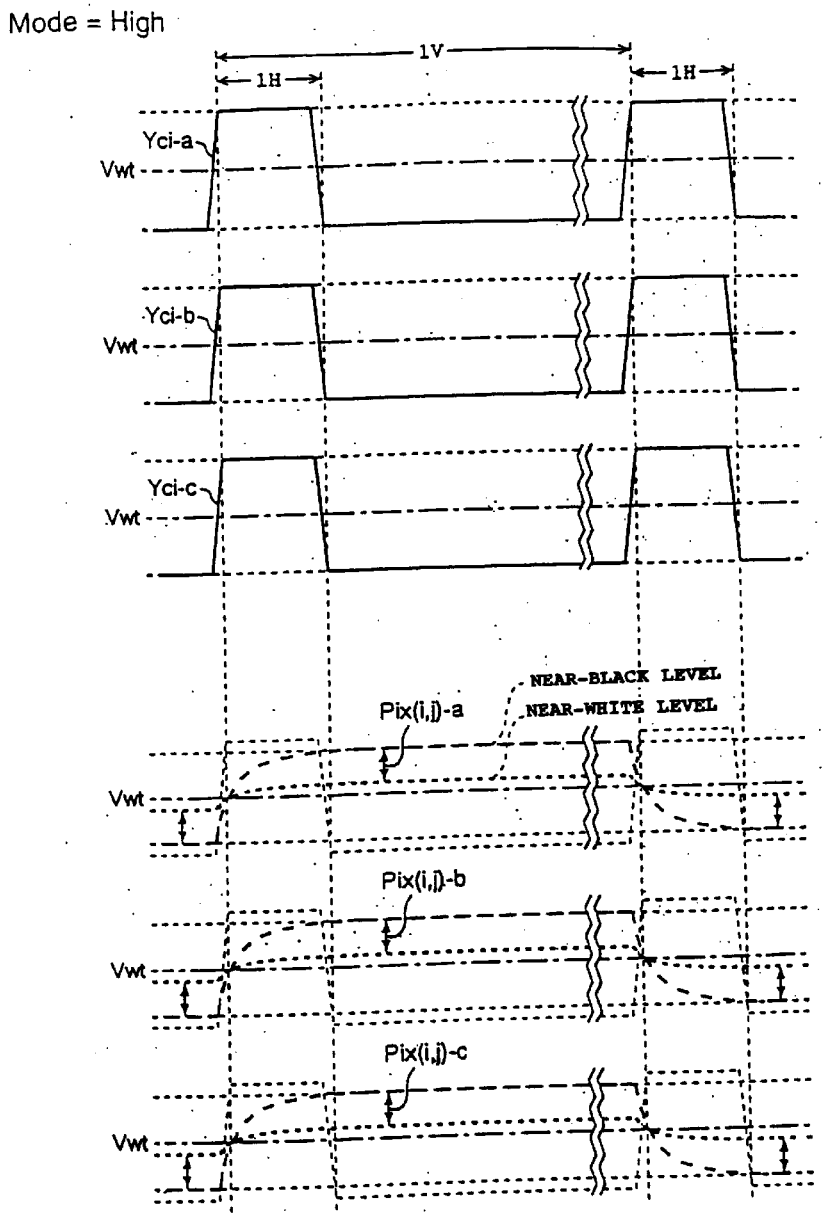
[FIG. 19]

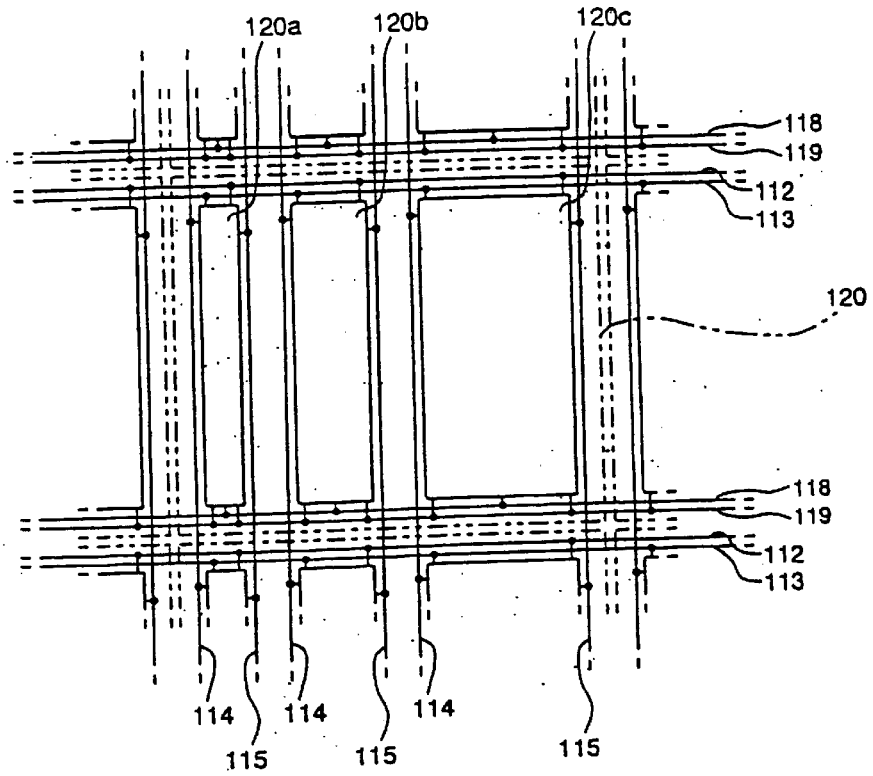
[FIG. 20]

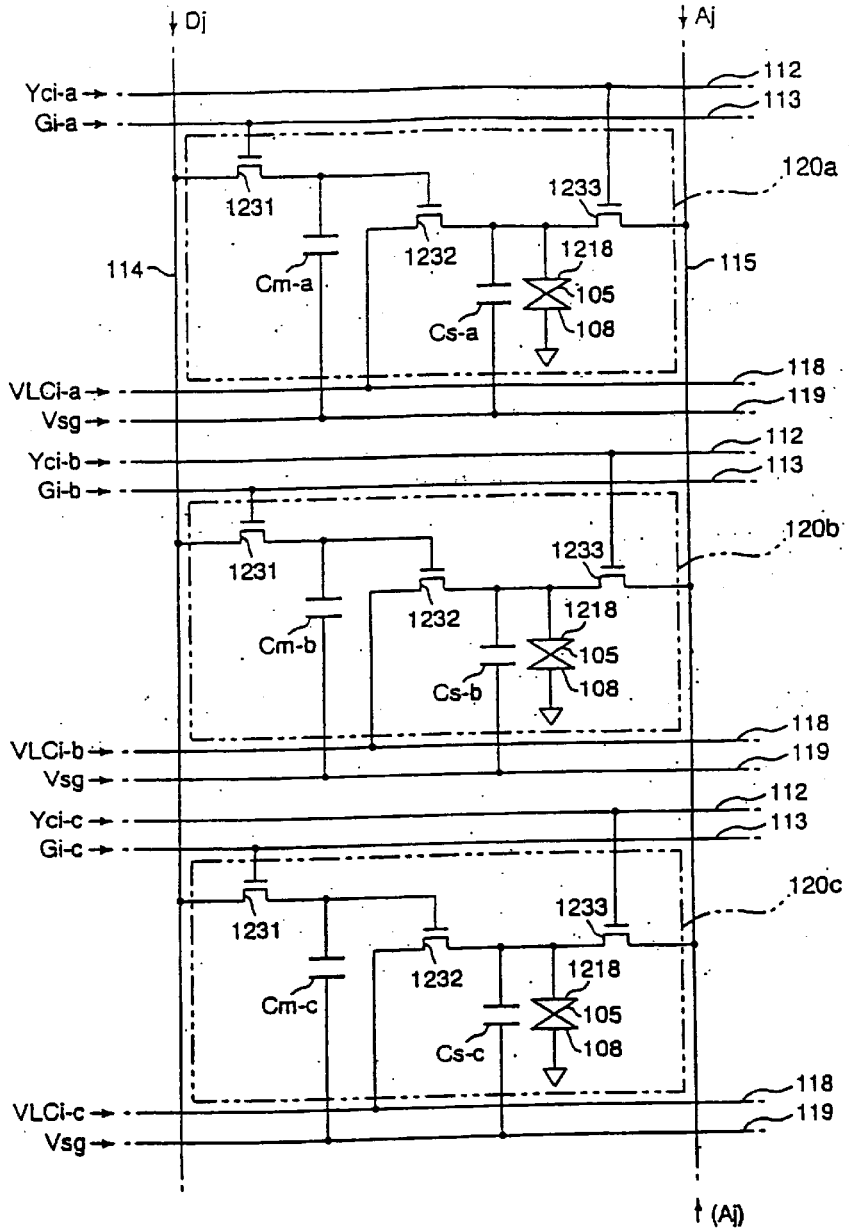
[FIG. 21]

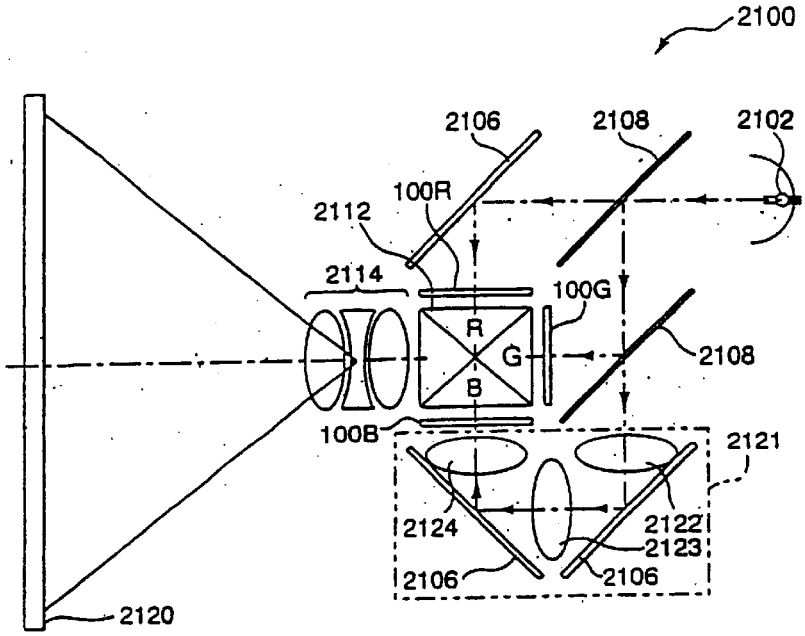
[FIG. 22]

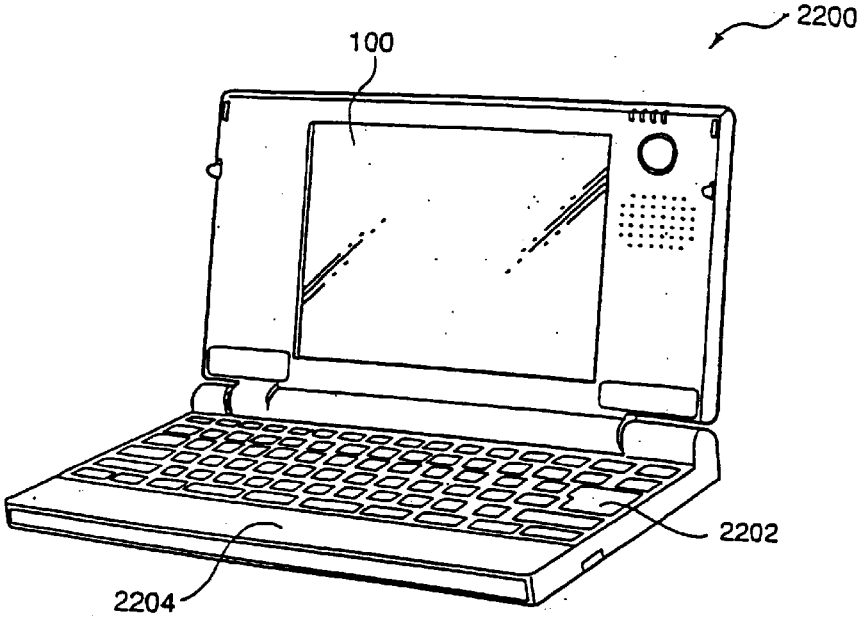
[FIG. 23]

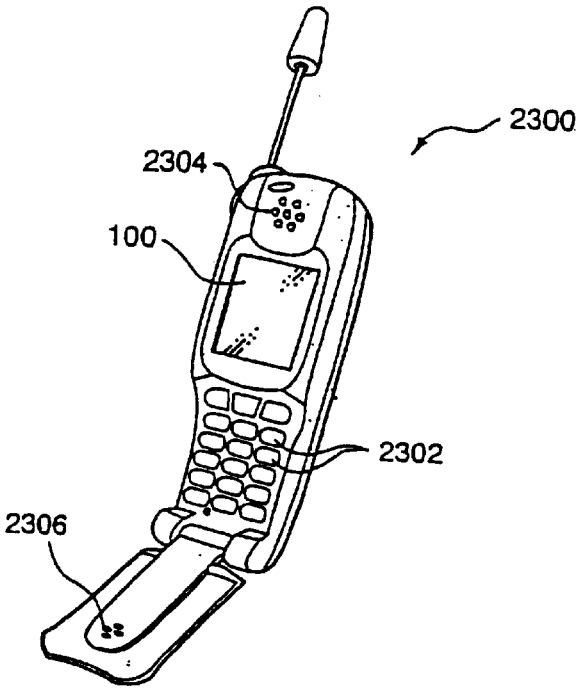
[FIG. 24]

DRIVING METHOD FOR ELECTRO-OPTICAL APPARATUS, DRIVING CIRCUIT THEREFOR, ELECTRO-OPTICAL APPARATUS, AND ELECTRONIC EQUIPMENT

BACKGROUND OF THE INVENTION

1. Field of Invention

The present invention relates to a driving method for an electro-optical apparatus that can provide a high-quality gradation display, a driving circuit therefor, an electro-optical apparatus, and electronic equipment.

2. Description of Related Art

Generally, an electro-optical apparatus performs display by utilizing an electro-optical change of an electro-optical material. A liquid crystal display unit employing liquid crystal as an electro-optical material, which is an alternative to a cathode ray tube (CRT), is widely used as a display portion of a display device in various types of information processing equipment.

A conventional liquid crystal display device has the following configuration. Specifically, the conventional liquid crystal display device includes a device substrate, on which pixel electrodes arranged in a matrix-like manner and switching devices connected to the pixel electrodes are provided, an opposing substrate on which counter electrodes respectively facing the pixel electrodes are formed, and liquid crystal serving as the electro-optical material sandwiched between these substrates.

Further, when a scanning signal is applied to one of the switching devices through a scanning line, this switching device is placed into a conducting state. When a voltage signal, corresponding to a gradation level, is applied to one of the pixel electrodes through a data line when the switching device is in the conducting state, electric charge, corresponding to the voltage signal, is stored between this pixel electrode and a corresponding one of the counter electrodes. Then, after the electric charge is stored therein, the storage of the electric charge in this liquid crystal layer is maintained due to the capacitive property and storage capacity of the liquid crystal layer, even when this switching device is placed into an off-state. In the case that each of the switching devices is driven in this manner, and the amount of the stored charge is controlled according to gradation levels, the orientation state of liquid crystal molecules changes. Thus, density levels vary with pixels. This enables the gradation display.

However, voltage signals applied to the data lines correspond to gradation levels and are analog signals. Thus, display unevenness is liable to occur due to nonuniformity of various device characteristics and wiring resistance.

An area gradation method is known wherein gradation levels are realized by dividing one pixel into a plurality of sub-pixels, and changing the on-state or off-state of each of the sub-pixels. In the case of the area gradation method, gradation levels are realized by only turning on or off the sub-pixels, so that it is sufficient to use binary voltage signals to be applied to the data lines. Consequently, it is unlikely that the display unevenness due to the nonuniformity of various device characteristics and wiring resistance will occur. However, according to this area gradation method, when the number of division of one pixel into sub-pixels is k, the number of gradation levels is $2^k$, and multi-level gradation display using gradation levels, the number of which is more than $2^k$, cannot be realized.

SUMMARY OF THE INVENTION

The invention is accomplished in view of such circumstances. An object of the invention is to provide a driving method for an electro-optical apparatus that can select a display suitable for various conditions by switching between a display performed according to the area gradation method and a display performed according to a multi-level gradation display using gradation levels, the number of which is more than that determined by the number of division of one pixel into sub-pixels. It is also an object of the invention to provide a driving circuit for such an electro-optical apparatus, such an electro-optical apparatus, and electronic equipment utilizing such electro-optical apparatus.

To achieve the foregoing object, according to a first aspect of the invention, there is provided a driving method for an electro-optical apparatus, adapted to drive a set of sub-pixels that adjoin one another and that are disposed correspondingly to intersections between scanning lines, which are formed in a direction of a row, and paired data lines, which include first and second data lines formed in a direction of a column, as one pixel. In this apparatus, each of the sub-pixels of the one pixel turns on or off in a first predetermined mode according to corresponding bits of gradation data, which designate a gradation level of the pixel and are supplied through a corresponding first data line. Further, a voltage signal, which corresponds to the gradation level of the pixel and is supplied through a corresponding second data line, is applied in a second predetermined mode in common to the sub-pixels of the one pixel.

According to this method, in the first mode, display is performed at each of the pixels in accordance with the area gradation method according to the on-states or off-states of the sub-pixels. At that time, it is sufficient that a binary signal designating a bit, according to which the sub-pixel is turned on or off, is used as the signal supplied to the data line. Therefore, it is difficult for such a signal to undergo the influence of the unevenness of the device characteristics and the wiring resistance. Thus, when the first mode is selected in the case of displaying a motionless image or an image subject to nominal motion, and in the case of displaying pixels having an equal gradation level in a wide area, high-quality display thereof is realized without display unevenness.

On the other hand, in the second mode, a voltage signal corresponding to the gradation data of one pixel, represented by a set of sub-pixels, is applied in common thereto. Thus, gradation display is performed so that the sub-pixels constituting one pixel have an equal density. Consequently, in the second mode, higher-level gradation display is enabled, regardless of the number of sub-pixels forming one pixel, that is, irrespective of the number of division of one pixel into sub-pixels. Thus, when the second mode is selected in the case of displaying a dynamic image, enriched multi-level gradation display thereof is realized.

The apparatus of the invention may have a separate decision unit that selects one of the first and second modes according to various conditions (such as the quality of an image, the remaining quantity of charge in a battery, the state of an operation). Alternatively, users may select the first or second mode manually.

According to the first aspect of the invention, preferably, the electro-optical apparatus has holding devices, which are provided correspondingly to each of the sub-pixels, that hold a corresponding bit of the gradation data. In this apparatus, the sub-pixels turn off once in the first mode regardless of data represented by the corresponding bit held in the holding devices. Thereafter, the sub-pixels turn on or off according to the bits of the gradation data, which are preliminarily held in the holding devices. According to this method, the sub-pixel is turned on or off according to the bit held by the holding device after the data to be displayed corresponding to the sub-pixel is reset to that corresponding to the off-state. Thus, it is unnecessary to rewrite the data that corresponds to the sub-pixel, whose on or off state is not changed, and that is held in the holding device. Therefore, there is no need to supply a bit to the first data line in a predetermined cycle. This enables high-quality display with low power consumption.

Further, according to the method of the invention, preferably, the second data lines are selected in a predetermined order in the second mode correspondingly to the sub-pixel corresponding to a selected row. Moreover, a voltage signal is applied to the selected second data line. According to this method, a circuit that supplies the voltage signal to the second data line can be simplified.

Meanwhile, according to the invention, preferably, in the second mode, voltage signals are simultaneously applied through to the second data lines the sub-pixels corresponding to the selected rows. According to this method, the voltage signals corresponding to the gradation levels are applied in line sequence to the second data line. Consequently, a sufficient time for applying voltage signals to the sub-pixels is secured.

Next, to achieve the foregoing object, according to the invention, there is provided a driving circuit for an electro-optical apparatus, adapted to drive a set of sub-pixels that adjoin one another in a direction of a column and that are disposed correspondingly to intersections between scanning lines, which are formed in a direction of a row, and paired data lines, which include first and second data lines formed in a direction of a column, as one pixel. The driving circuit includes:

a scanning line driving circuit that outputs, in a first predetermined mode, a scanning signal, which selects the scanning lines line by line, to each of the scanning lines and outputs, in a second predetermined mode, a scanning signal, which selects the scanning lines every lines of the number of the sub-pixels of one pixel, to each of the scanning lines; and a data line driving circuit that outputs, in the first predetermined mode, a corresponding bit of gradation data representing a gradation level of a pixel including the sub-pixel, which corresponds to the intersection corresponding to the scanning line selected by the scanning line driving circuit, to a corresponding first data line and outputs, in the second mode, a voltage signal corresponding to a gradation level of the pixel to corresponding second data lines that corresponds to the intersection corresponding to the sub-pixels grouped as one pixel. According to the second aspect of the invention, high-quality display with no display unevenness is enabled, similarly as in the case of the method of the first aspect of the invention. Moreover, enriched gradation display is realized.

Incidentally, according to the second aspect of the invention, preferably, the data line driving circuit includes a first driving circuit, and a second driving circuit. Further, the first driving circuit outputs a bit to the first data line in the first mode. Moreover, one of the first driving circuit and the second driving circuit outputs a voltage signal to the second data line. With this configuration, there are caused two cases that the first driving circuit operates in both the first and second modes, and that the first driving circuit operates in the first mode, while the second driving circuit operates in the second mode. That is, according to the second aspect of the invention, in the second mode, there are two cases that the data lines are driven by the first driving circuit, and that the data lines are driven by the second driving circuit.

Meanwhile, according to this aspect of the invention, the first driving circuit may include a first circuit that outputs, in the first mode, a corresponding bit of gradation data of a pixel including one of sub-pixels, which is placed on the selected scanning line to the first data line corresponding to the one of sub-pixels, and a second circuit that outputs, when the second driving circuit outputs a voltage signal only to the second data line in the second mode, data obtained by performing a digital-to-analog conversion on gradation data of a pixel including one of the sub-pixels, which is placed on the selected scanning line, to the second data line corresponding to the one of the sub-pixels. With this configuration, in the first mode, the corresponding bit of the gradation data is outputted. On the other hand, in the second mode, a voltage signal representing a result of the digital-to-analog conversion of the gradation data is outputted. In both of these cases, digital gradation data can be directly inputted to the apparatus.

Further, according to this aspect of the invention, the second driving circuit may be a circuit that samples and outputs, when the first driving circuit outputs a voltage signal only to the second data line in the second mode, voltage signals, whose levels correspond to a gradation level of a pixel including one of the sub-pixels, which is placed on the selected scanning line, in sequence to the second data line corresponding to the one of the sub-pixels. With this configuration, in the first mode, digital gradation data can be inputted to the apparatus, and additionally, conventional analog signals can be inputted thereto in the second mode.

Furthermore, to achieve the foregoing object of the invention, according to a third aspect of the invention, there is provided an electro-optical apparatus, which is adapted to drive a set of sub-pixels that adjoin one another in a direction of a column and that are disposed correspondingly to intersections between scanning lines, which are formed in a direction of a row, and paired data lines, which include first and second data lines formed in a direction of a column, as one pixel. The apparatus includes a scanning line driving circuit that outputs, in a first predetermined mode, a scanning signal, which selects the scanning lines line by line, to each of the scanning lines and that outputs, in a second predetermined mode, a scanning signal, which selects the scanning lines every lines of the number of the sub-pixels of one pixel, to each of the scanning lines, and a data line driving circuit that outputs, in the first predetermined mode, a corresponding bit of gradation data representing a gradation level of a pixel including the sub-pixel, which corresponds to the intersection corresponding to the scanning line selected by the scanning line driving circuit, to a corresponding first data line and that outputs, in the second mode, a voltage signal corresponding to a gradation level of the pixel to corresponding second data lines that corresponds to the intersection corresponding to the sub-pixels grouped as one pixel. According to the third aspect of the invention, high-quality display with no display unevenness is enabled by selecting the first mode, similarly as in the case of the first and second aspects of the invention. Moreover, enriched gradation display is realized by selecting the second mode.

According to the third aspect of the invention, preferably, the sub-pixel includes a first switch, adapted to turn on or off in the first mode according to a signal supplied to a write control line provided correspondingly to each of the scanning lines, a holding device that holds, when the first switch turns on in the first mode, data according to a bit supplied to a corresponding one of the first data lines, a second switch that selects, after a signal, which turning off the sub-pixel, is selected in the first mode regardless of data held in the holding device, a signal causing the sub-pixel to turn on or off according to the data held in the holding device, a third switch, which is adapted to turn on or off according to a scanning signal supplied to a corresponding one of the scanning lines in the second mode, that samples voltage signals supplied to the corresponding second data line, and a sub-pixel electrode to which a signal selected by the second or third switch is applied. With this configuration, in the first mode, the sub-pixel is turned on or off according to the bit held by the holding device after the data to be displayed at the sub-pixel is once reset to the off-state thereof. Thus, it is unnecessary to rewrite the data that corresponds to the sub-pixel, whose on or off state is not changed, and that is held in the holding device. Therefore, there is no necessity to supply a bit to the first data line in a predetermined cycle. This enables high-quality display with low power consumption. Incidentally, in the apparatus of this configuration, in the second mode, the third switch performs the sampling of the voltage signals supplied to the second data line.

Further, according to the third aspect of the invention, preferably, the electro-optical apparatus further includes a storage capacitance that holds a voltage applied to a corresponding sub-pixel electrode. With this configuration, in the second mode, the leakage of the voltage applied to the sub-pixel electrode is suppressed.

According to this apparatus, preferably, the storage capacitance has an end connected to the sub-pixel electrode and also has the other end connected to a potentiostatic signal line. With this configuration, the storage capacitance holds the voltage between the potentiostatic signal line and the pixel electrode, irrespective of the mode.

Further, as described above, in the second mode, the apparatus performs the gradation display according to the area gradation method utilizing the turning-on or off of the sub-pixels. Thus, it is preferable that the capacity of the storage capacitance is determined according to the area of a corresponding sub-pixel electrode.

Furthermore, electronic equipment according to the invention comprises the aforementioned electro-optical apparatus of the invention. Thus, high-quality display with no display unevenness is enabled by selecting the first mode. Moreover, enriched gradation display is realized by selecting the second mode.

BRIEF DESCRIPTION OF THE DRAWINGS

FIG. 1(*a*) is a perspective view illustrating an electro-optical apparatus according to an embodiment of the invention, and FIG. 1(*b*) is a sectional view taken along plane A–A' of FIG. 1(*a*).

FIG. 2 is a schematic illustrating the electrical configuration of the electro-optical apparatus.

FIG. 3 is a plan view illustrating the arrangement of sub-pixels of the electro-optical apparatus.

FIG. 4 is a circuit diagram illustrating the configuration of a circuit corresponding to one pixel in the electro-optical apparatus.

FIGS. 5(*a*), (*b*) and (*c*) are circuit diagrams, each illustrating an operation of a sub-pixel in the case that a signal mode is at an L-level.

FIGS. 6(*a*), (*b*) and (*c*) are circuit diagrams, each illustrating an operation of a sub-pixel in the case that a signal mode is at an L-level.

FIGS. 7(*a*) and (*b*) are circuit diagrams, each illustrating an operation of a sub-pixel in the case that a signal mode is at an H-level.

FIG. 8 is a circuit diagram illustrating the configuration of a scanning signal selector in a scanning line driving circuit thereof.

FIG. 9 is a timing chart illustrating an operation of the scanning line driving circuit thereof.

FIG. 10 is a circuit diagram illustrating the configuration of a VLC selector of the electro-optical apparatus.

FIG. 11 is a timing chart illustrating an operation of the VLC selector thereof.

FIG. 12 is a schematic illustrating the configuration of a first data line driving circuit of the electro-optical apparatus.

FIG. 13 is a circuit diagram illustrating the configuration of second latch circuits corresponding to one column in the first data line driving circuit thereof.

FIG. 14 is a circuit diagram illustrating the configuration of a second data line driving circuit of the electro-optical apparatus.

FIG. 15 is a timing chart illustrating a data writing operation in the case that a signal mode is at an L-level in the electro-optical apparatus.

FIG. 16 is a timing chart illustrating a display operation in which the signal mode is at an L-level.

FIG. 17 is a timing chart illustrating an operation in the case that the signal mode is at an H-level in the electro-optical apparatus, and that a signal DDS is at an L-level.

FIG. 18 is a timing chart illustrating an operation in the case that the signal mode is at an H-level in the electro-optical apparatus, and that a signal DDS is at an H-level.

FIG. 19 is a timing chart illustrating a display operation of a sub-pixel in the case that a signal mode is at an H-level.

FIG. 20 is a plan view illustrating an arrangement of pixels in the electro-optical apparatus.

FIG. 21 is a circuit diagram illustrating the configuration of a circuit corresponding to one pixel in the electro-optical apparatus.

FIG. 22 is a schematic illustrating the configuration of a projector that is an example of electronic equipment, to which an embodiment of the electro-optical apparatus is applied.

FIG. 23 is a perspective view illustrating the configuration of a personal computer that is an example of electronic equipment, to which an embodiment of the electro-optical apparatus is applied.

FIG. 24 is a perspective view illustrating the configuration of a hand-portable telephone set that is an example of electronic equipment to which the electro-optical apparatus is applied.

DETAILED DESCRIPTION OF PREFERRED EMBODIMENTS

Hereinafter, an embodiment of the invention is described with reference to the accompanying drawings.

<Configuration of Electro-optical Apparatus>

First, an electro-optical apparatus according to this embodiment is described hereinbelow. This electro-optical apparatus is a liquid crystal apparatus of the transmissive type that employs liquid crystal as an electro-optical material, and that performs predetermined display by utilizing an electro-optical change thereof. Further, in this electro-optical apparatus, each of pixels is constituted by three sub-pixels. As will be described below, this electro-optical apparatus is adapted so that display, according to the area gradation method using three sub-pixels of each pixel, is performed in a first mode, and that display obtained by causing the three sub-pixels of each pixel to represent a common density level is performed in a second mode. Moreover, in the second mode, there are two cases. One is the case that digital gradation data is inputted to this electro-optical apparatus, and then the apparatus uses analog data obtained by performing digital-to-analog conversion on the inputted digital data. The other is the case that analog image signals are inputted to the apparatus and then used therein without being changed.

FIG. 1(*a*) is a perspective view illustrating the configuration of this electro-optical apparatus 100. FIG. 1(*b*) is a sectional view taken along plane A–A' of FIG. 1(*b*). As shown in these figures, in the electro-optical apparatus 100, a device substrate 101, on which various devices and sub-pixel electrodes 1218, and an opposing substrate 102, on which counter electrodes 108 are provided, are stuck to each other so that these substrates are spaced apart from each other by maintaining a gap, which has a constant width, by the use of a sealing member 104 including a spacer 103. The electrode forming surfaces of these substrates face each other. Liquid crystal 105 of the TN (Twisted Nematic) type is filled into this gap as an electro-optical material. Additionally, three sub-pixel electrodes 1218 correspond to one pixel. However, to perform the display according to the area gradation method in the first mode, as will be described below, the ratio among the areas of the three sub-pixel electrodes 1218 is set in such a manner as to be nearly 1:2:4.

Incidentally, in this embodiment, glass, semiconductors, or quartz are employed as the material of the device substrate 101. However, an opaque substrate may be used as the device substrate 101. Incidentally, in the case of employing such an opaque substrate as the substrate 101, this opaque substrate is used as a substrate of the reflection type. Moreover, although the sealing member 104 is formed along the periphery of the opposing substrate 102, the sealing member 104 is partly opened so as to fill the liquid crystal 105 into the gap. Thus, after the liquid crystal is filled thereinto, an opened portion is sealed with an encapsulant 106.

Further, a first data line driving circuit 180 of a data line driving circuit (to be described below) is formed on an outer side of the sealing member 104, which is an opposed surface of the device substrate 101. Furthermore, a plurality of mounting terminals 107 are formed on a peripheral portion of this side of the member 104. Moreover, scanning line driving circuits 130 are formed on two sides adjoining the outer side, respectively, so that each of the display scanning lines and the writing scanning lines is driven from both sides thereof. Additionally, in addition to a second data line driving circuit 190, wiring (not shown) used in common by two scanning line driving circuits 130 is formed on the remaining one side of the sealing member 104. Incidentally, when a delay in a scanning signal supplied to the scanning line causes no trouble, the apparatus may be configured by forming the scanning line driving circuit 130 on only one of the two adjoining sides.

Constituent elements of the circuit formed on the periphery of the device substrate 101, such as the scanning line driving circuits 130, the first data line driving circuit 180, and the second data line driving circuit 190, are formed in, for example, a common low-temperature polysilicon process that is also used for forming thin film transistors (hereunder referred to as "TFTs") that constitute the sub-pixels. The incorporation of the peripheral circuit into the device substrate 101, and the formation of the constituent elements of the peripheral circuit in the common process, are advantageous for reduction in the size of the entire apparatus and in the cost thereof, as compared with an electro-optical apparatus of the type in the case that the peripheral circuit is formed on an additional separate substrate and externally provided.

On the other hand, each of the counter electrodes 108 formed on the opposing substrate 102 is electrically connected to a corresponding one of the mounting terminals 107, which are formed on the device substrate 101, through a conductive member provided at least at one of four corners of a portion at which this electrode 108 is stuck to the substrate 101.

Additionally, a colored layer (or color filter) is provided on a region, which faces the pixel electrode 1218, of the opposing substrate 102, though the colored layer is not shown in the figures. Incidentally, in the case of using the electro-optical apparatus for color light modulation in, for instance, a projector (to be described below), the colored layer does not need to be formed on the opposing substrate 102. Furthermore, regardless of whether or not the colored layer is provided therein, a light shielding film (not shown) is provided on a part other than the region facing the sub-pixel electrode 1218 so as to prevent a contrast ratio from being degraded owing to the leakage of light.

Further, an oriented film (not shown) that undergoes a rubbing treatment is provided on each of the opposed surfaces of the device substrate 101 and the opposing substrate 102, so that the direction of the long axis of the liquid crystal molecules 105 is continuously twisted by an angle of about 90 degrees between both the substrates. On the other hand, a polarizer, corresponding to the orientation direction of the liquid crystal molecules 105, is provided on each of the rear sides thereof. However, the polarizers do not directly relate to the invention. Thus, the polarizers are not shown in the figures. Although it is shown in FIG. 1(*b*) for convenience in illustrating the positional relation that the counter electrodes 108, the pixel electrodes 1218, and the mounting terminals 107 each have a thickness, the actual thickness of each of these elements is small to the extent that such thickness thereof is negligible in comparison with the thickness of each of the substrates.

<Electrical Configuration of Electro-optical Apparatus>

Next, the electrical configuration of the electro-optical apparatus according to this embodiment of the invention is described hereinbelow. FIG. 2 is a schematic illustrating this electrical configuration of the apparatus. As shown in this figure, in this embodiment, 3 m scanning-line pairs, each including a display scanning line 112 and a writing scanning line 113, are formed in such a way as to extend in the X-direction (or in the direction of a row). Further, n data-line pairs, each including a digital data line (or first data line) 114 and an analog data line (or second data line) 115, are formed in such a way as to extend in the Y-direction (or the direction of a column) (incidentally, both of "m" and "n" are integers). Moreover, sub-pixels 120*a*, 120*b*, and 120*c* are arranged in such a way as to respectively correspond to the intersections between the scanning-line pairs and the data-line pairs. One pixel 120 is constituted by three sub-pixels 120*a*, 120*b*, and 120*c* that are consecutively arranged in the direction of a column. Thus, in this embodiment, the pixels 120 are arranged like an m×n matrix.

Furthermore, a signal line 118 and a capacitance line 119 are formed in the direction along the scanning-line pair correspondingly to each row. Incidentally, in FIG. 2, the display scanning line 112, the writing scanning line 113, the signal line 118, and the capacitance line 119 are shown as being arranged at equal intervals of distance. However, actually, the sub-pixels 120*a*, 120*b*, and 120*c* are formed so that the ratio among the areas of the sub-pixels 120*a*, 120*b*, and 120*c* is about 1:2:4. Thus, the display scanning line 112, the writing scanning line 113, the signal line 118, and the capacitance line 119 are actually arranged at the intervals determined according to this ratio, as shown in FIG. 3.

Incidentally, in the case of the electro-optical apparatus according to this embodiment, there are two kinds of operation modes, that is, a first mode and a second mode. Furthermore, in the latter mode, that is, the second mode, there are two kinds of cases of operating the apparatus, that is, a first case, and a second case. Between these modes, in the first mode, display using 8 gradation levels represented by 3-bit gradation level data (Data) corresponding to each pixel is performed. Further, in the first case of the second mode, display using 16 gradation levels represented by 4-bit gradation data (Data) corresponding to each pixel is performed. Moreover, in the second case of the second mode, display is performed according to an analog signal supplied from an external circuit.

Particularly, in the first mode, the electro-optical apparatus according to this embodiment performs 8-level area gradation display by turning on or off the sub-pixels 120*a*, 120*b*, and 120*c* according to the values respectively represented by the least significant bit, the second bit, and the most significant bit of the gradation data (Data). In contrast, in the first case of the second mode, the apparatus performs 16-level gradation display by sampling voltage signals that are obtained by the digital-to-analog conversion of the 4-bit gradation data correspondingly to each of the three sub-pixels of each single pixel. Furthermore, the apparatus performs gradation display by sampling analog image signals supplied from the external circuit through image signal lines 191. Incidentally, in both the first and second cases of the second mode, the apparatus performs display so that the three sub-pixels of each single pixel have a common density level.

Subsequently, the scanning line driving circuit 130 has a (3m+2)-stage shift register 132 and a scanning signal selector 134, and supplies scanning signals in a predetermined order to each of the display scanning lines 112 and the writing scanning lines 113. Incidentally, for convenience of description, in FIG. 2, reference characters Yci-a, Yci-b, and Yci-c denote scanning signals to be respectively supplied to three sub-pixels 120*a*, 120*b*, and 120*c* of a given pixel 120 positioned on an i-th row from the top one through the display scanning line 112. Further, reference characters Yi-a, Yi-b, and Yi-c designate scanning signals to be respectively supplied thereto through the writing scanning line 113. Incidentally, "i" is one of integers between 1 and m in principle. However, as an exception, there is a scanning signal Y0-*c* because a zeroth row is assumed in relation to the scanning signals to be supplied to the writing scanning line 113.

Further, in the first mode, the scanning line driving circuit 130 outputs and supplies the display scanning lines 112 scanning signals, whose active periods do not overlap with one another and are equal in length to (⅓) the horizontal scanning period, from the top to the bottom row by row, as viewed in FIG. 2. Moreover, the circuit 130 outputs similar scanning signals to each of the writing scanning lines 113. Each of scanning signals to be supplied to the display scanning line 112 corresponding to a given row is outputted at a moment, which precedes a moment at which a scanning signal to be supplied to the writing scanning line 113 corresponding to the same row, by a time period that is equal in length to (⅓) the horizontal scanning time period. Moreover, scanning signals, to be actually fed to the writing scanning line 113, are supplied thereto through an AND-gate 152 (to be described below).

On the other hand, in the second mode, the scanning line driving circuit 130 outputs and supplies the display scanning lines 112 scanning signals, whose active periods do not overlap with one another and are equal in length to the horizontal scanning period, from the top to the bottom every three rows corresponding to three sub-pixels of one pixel in common in both the first and second cases. Further, the circuit 130 outputs the writing scanning lines 113 scanning signals that are always at an active level. Incidentally, the detailed configuration of this scanning line driving circuit 130 will be described below.

Furthermore, the VLC selectors 140 are provided corresponding to each row and selects one of voltage signals Vbk(+), Vwt, and Vbk(−), and then outputs the selected voltage signal to the signal line 118. Incidentally, the voltage signal Vbk(+) is a positive-polarity side signal that causes the sub-pixel to turn on when this signal is applied to the corresponding sub-pixel electrode 1218 (see FIG. 4). Further, the voltage signal Vwt causes the sub-pixel to turn off when this signal is applied to the corresponding sub-pixel electrode 1218. Moreover, the voltage signal Vbk(−) is a negative-polarity side signal that causes the sub-pixel to turn on when this signal is applied to the corresponding sub-pixel electrode 1218. Particularly, in this embodiment, the liquid crystal 105 is sandwiched between the sub-pixel electrode 1218 and the counter electrode 108, as described above. Thus, the voltage level of the signal, causing the sub-pixel to turn off, is nearly equal to the level of the voltage applied to the counter electrode 108. Additionally, a positive polarity side signal, causing the sub-pixel to turn on, is a higher-level on-voltage signal representing the voltage that is higher than the voltage to be applied to the counter electrode 108. Moreover, a negative polarity side signal, causing the sub-pixel to turn on, is a lower-level level on-voltage signal representing the voltage that is lower than the voltage to be applied to the counter electrode 108.

Further, the VLC selector 140 selects one of the voltage signals Vbk(+), Vwt, and Vbk(−) as follows. That is, in the case that the voltage signal Vbk(+) is selected in the first mode, the VLC selector 140 selects the voltage signal Vwt when the scanning signal supplied to the corresponding display scanning line 112 becomes at an active level (that is, when the scanning signal to be applied to a writing scanning line that is one row above the corresponding writing scanning line 113 becomes at an active level). Subsequently, the selector 140 selects the voltage signal Vbk(−), having a polarity that is opposite to the polarity selected, before the voltage signal Vwt is selected.

Conversely, in the case that the voltage signal Vbk(−) is selected in the first mode, the selector 140 selects the voltage signal Vwt when the scanning signal applied to the corresponding display scanning signal 112 becomes at an active level. Subsequently, the selector 140 selects the voltage signal Vbk(+) having the polarity opposite to the polarity selected before such selection of the voltage Vwt. Incidentally, in the second mode, the VLC selector 140 always selects the same voltage signal, for instance, the voltage signal Vbk(−) in this embodiment.

Incidentally, for convenience of description, generally, in order to specify rows corresponding to the sub-pixels 120*a*, 120*b*, and 120*c*, among the pixels 120 placed on the ith row, a row corresponding to the sub-pixel 120*a* is designated by reference character "i-a". Further, a row corresponding to the sub-pixel 120*b* is designated by reference character "i-b". Moreover, a row corresponding to the sub-pixel 120*c* is designated by reference character "i-c". Additionally, in this case, the sub-pixels respectively corresponding to three rows, that is, rows i-a, i-b, and i-c constitute pixels of 1 row that is an ith row.

Further, the voltage signals corresponding to the rows i-a, i-b, and i-c, which are selected by the VLC selector 140, are denoted by VLCi-a, VLCi-b, and VLCi-c, respectively. Incidentally, the detailed configuration of this VLC selector 140 will be described below.

Further, an enable circuit 150 is constituted by an AND gate 152 corresponding to one of the writing scanning lines 113. A scanning signal outputted by the scanning line driving circuit 130, correspondingly to the writing scanning line 113, is supplied to one of the input terminals of the AND-gate 152. Further, a signal ENB is supplied in common to the other of the input terminals of the AND-gate 152. Thus, when the signal ENB is at an H-level, each of the AND-gates 152 is enabled. Therefore, the scanning signal supplied from the scanning line driving circuit 130 is outputted therefrom without being changed. Conversely, when the signal ENB is at an L-level, all the AND-gates 152 are disabled, so that the output of the scanning signal is inhibited. Additionally, for convenience of description, scanning signals, finally supplied to the writing scanning lines 113 respectively corresponding to the rows i-a, i-b, and i-c, are designated by Gi-a, Gi-b, and Gi-c.

Meanwhile, this embodiment has two data line driving circuits, that is, the first data line driving circuit 180 and the second data line driving circuit 190 as the data line driving circuits. Both the data line driving circuits are not used simultaneously in a display operation. In the first mode, and in the first case of the second mode, the former or first data line driving circuit 180 is used. In contrast, in the second case of the second mode, the latter or second data line driving circuit 190 is used.

Incidentally, in this embodiment, it is determined according to, for example, the level of a signal Mode outputted by an external control circuit which of the first mode and the second mode is designated. That is, when the signal Mode has an L-level, the first mode is designated. Conversely, when the signal Mode has an H-level, the second mode is designated. Thus, the signal Mode is supplied to the VLC selector 140 and the scanning line driving circuit 130 (that is, the scanning signal selector 134) in addition to the first data line driving circuit 180.

Further, similarly, it is determined according to, for instance, a signal DDS outputted by an external control circuit which of the first and second cases in the first mode is designated. That is, when the signal DDS is at an L-level, the first case is designated. Conversely, when the signal DDS is at an H-level, the second case is designated. Thus, the signal DDS is supplied to the first data line driving circuit 180 and the second data line driving circuit 190. Incidentally, the signal DDS becomes effective in the second mode in which the signal Mode is at an H-level. Thus, it is assumed in this embodiment that the signal DDS is at some level in the first mode in which the signal Mode is at an L-level.

Meanwhile, in the first mode, the first data line driving circuit 180 supplies a bit corresponding to a sub-pixel placed on a row corresponding to the writing scanning line 113, through which the scanning signal having been at the active level flows, to a corresponding one of the digital data line 114 among gradation data (Data) of one pixel, which is represented by the sub-pixel. Further, the circuit 180 supplies the voltage signal Vwt to all of the analog data lines 115.

On the other hand, in the first case of the second mode, the first data line driving circuit 180 supplies a signal having an L-level to all the digital data lines 114 and also supplies an analog signal, which is obtained by performing a digital-to-analog conversion of the gradation data of this pixel, to analog data lines 115 corresponding to three sub-pixels (that is, the three sub-pixels constituting one pixel) placed on three rows corresponding to the display scanning lines 12, through which the scanning signals being at the active level flow.

Moreover, in the second case of the second mode, the second data line driving circuit selects the analog data lines 115 in sequence in a horizontal scanning period, and performs the sampling of analog image signals supplied from an external circuit, and supplies the sampled signals to the selected analog data line 115.

Incidentally, the details of the first data line driving circuit 180 and the second data line driving circuit 190 will be described below. Further, for convenience of description, a data signal supplied to the digital data line 114 corresponding to a j-th column from the leftmost one is designated by reference character Dj. Similarly, a data signal supplied to the analog data line 115 corresponding to a j-th column from the leftmost one is designated by reference character Aj (incidentally, "j" is one of integer between 1 to n). Furthermore, the scanning line driving circuit 130 is illustrated in FIG. 2 as being provided at one end and on one side of the scanning line, differently from that shown in FIG. 1. However, FIG. 2 is illustrated only for convenience of description of the electrical configuration of the apparatus.

<Details of Sub-pixels>

Further, the detailed configuration of each of the sub-pixels 120*a*, 120*b*, and 120*c* in the electro-optical apparatus is described hereinbelow. FIG. 4 is a circuit diagram illustrating the configurations of the sub-pixels 120*a*, 120*b*, and 120*c*. In FIG. 4, generally, a set of the three sub-pixels 120*a*, 120*b*, and 120*c* corresponds to one pixel 120 located on an ith row and on a j-th column. This set of sub-pixels and the one pixel have the same electrical configuration (incidentally, these differ from each other in the area thereof). Therefore, hereinafter, the sub-pixel 120*a* adapted to turn on or off corresponding to the least significant bit of the gradation data is described by way of example.

First, this sub-pixel 120*a* has three switches 1201, 1202, and 1203. Among these switches, the switch 1201 (namely, the first switch) is adapted to turn on when the scanning signal Gi-a is at the active level (namely, an H-level). A terminal of the first switch is connected to the digital data line 114, to which the data signal Dj is supplied. The other end thereof is connected to one of the electrodes of the capacitance Cm-a serving as the holding device, and to a control input terminal of the switch 1202. On the other hand, the other electrode of the capacitance Cm-a is connected to a capacitive line 119 to which constant potential Vsg is applied. Incidentally, the capacitive line 119 is connected in common to all the sub-pixels, as illustrated in FIG. 2.

Further, the switch 1202 (namely, a second switch) is adapted to turn on when one of the electrode voltage of the capacitance Cm-a is an H-level. Thus, the voltage signal VLCi-a supplied thereto through the signal line 118 is applied to the pixel electrode 1218.

Moreover, the switch 1203 (namely, the third switch) is adapted to turn on when the scanning signal Yci-a is at the active level. A terminal thereof is connected to the analog data line 115 to which the data signal Aj is supplied, while the other terminal thereof is connected to the sub-pixel 1218. Thus, when the switch 1203 turns on, the data signal Aj is applied to the sub-pixel electrode 1218. Incidentally, the storage capacitance ca-a is parallel-connected to the liquid crystal capacitance in which the liquid crystal 105 is sandwiched between the sub-pixel electrode 1218 and the counter electrode 108.

Additionally, the detailed configurations of the sub-pixels 120*b* and 120*c* are electrically the same as that of the sub-pixel 120*a*. Incidentally, the ratio among the liquid crystal capacitances 120*a*, 120*b*, and 120*c* is about 1:2:4 according to the area ratio in the sub-pixel electrode 1218. Thus, for convenience of description, the storage capacitance of the sub-pixel 120*b* is designated by reference character Cs-b, while the storage capacitance of the sub-pixel 120*c* is designated by reference character Cs-c. The ratio among the storage capacitances Cs-a, Cs-b, ad Cs-c is set according to the area ratio in the sub-pixel electrode 1218.

Next, an operation of the sub-pixel of such a configuration is described hereinbelow by briefly describing that of the sub-pixel 120*a* by way of example. Incidentally, it is assumed that this embodiment operates in a normally white mode, wherein white display is performed in a condition in which no voltage is applied thereto.

First, an operation of the sub-pixel 120*a* in the first mode is described hereinbelow. In this case, when the scanning signal Gi-a to be supplied through the writing scanning line 113 is at an active level, and the switch 1201 turns on, the level of the bit represented by the data signal Dj, which is supplied through the digital data line 114, is held at one of the electrodes of the capacitance Cm-a. At that time, when white display is performed at the sub-pixel 120*a*, the bit level designated by the data signal Dj becomes an L-level, as illustrated in FIG. 5(*a*). In contrast, when black display is performed at the sub-pixel 120*a*, the bit level designated by the data signal Dj becomes an H-level, as illustrated in FIG. 6(*a*).

Subsequently, when the scanning signal Gi-a is at a non-active level (namely, an L-level) and the switch 1201 turns off, the switch 1202 turns on or off according to the voltage at one of the electrodes of the capacitance Cm-a. At that time, the voltage signal Vbk(+) or Vbk(−) selected by the VLC selector 140, that is, the voltage required for performing black display of the sub-pixel is supplied to the signal line 118.

It is now assumed that white display of this sub-pixel 120*a* is performed. The voltage at one of the electrodes of the capacitance Cm-a is held at the L-level, so that the switch 1202 turns off. Thus, as illustrated in FIG. 5(*a*), the voltage signal Vbk(+) or Vbk(−) for the black display is not applied to the sub-pixel electrode 1218. Therefore, white display is performed at this sub-pixel 120*a*. In contrast, when black display is performed at the sub-pixel 120*a*, the voltage at one of the electrodes of the capacitance Cm-a is held at the H-level, so that the switch 1202 turns on. Thus, as illustrated in FIG. 6(*c*), the voltage signal Vbk(+) or Vbk(−) for the black display is applied to the electrode 1218, so that black display is performed at the sub-pixel 120*a*.

On the other hand, in the first mode, in the case that no change occurs in the display state of the sub-pixel, the signal NB (see FIG. 2) is at an L-level. Thus, the signal level of the scanning signal Gi-a does not become an active level, so that the non-active level thereof is maintained. Incidentally, to AC-drive the liquid crystal capacitance, the voltage signal is alternately switched between Vbk(+) and Vbk(−) in a vertical scanning period by the VLC selector 140, as will be described below. Further, when the voltage signal is changed, a display refresh operation (to be described hereinbelow) is performed at each of the sub-pixels.

That is, when the scanning signal Yci-a supplied through the display scanning data 112 is at an active level, the switch 1203 turns on. Thus, the level of the data signal Aj supplied through the analog data line 115 is written to the sub-pixel electrode 1218.

Incidentally, in the first mode, the white display voltage signal Vwt is supplied to each of the analog data lines 115, as described above (the details thereof will be described below). In contrast, when the scanning signal Yci-a is at the active level, the voltage signal Vwt is selected as the voltage signal VLCi-a to be supplied to the signal line 118 corresponding thereto, as will be described below.

Therefore, when the switch 1203 is turned on, in both the cases that white display should be performed at this sub-pixel 120*a*, and that black display should be performed thereat, the voltage to be applied to the sub-pixel electrode 1218 is the white display voltage signal Vwt, as illustrated in FIG. 5(*b*) or in FIG. 6(*b*). Incidentally, when the scanning signal Yci-a is at the non-active level and the switch 1203 turns off, the switch 1202 turns off as illustrated in FIG. 5(*c*), in the case that white display should be performed. Thus, the white display state is maintained. Conversely, in the case that black display should be performed, the switch 1202 turns on, as illustrated in FIG. 6(*c*). Therefore, the black display voltage signal Vbk(+) or Vbk(−), which is obtained by the polarity inversion, is supplied through the signal line 118, so that the display state is changed to the black display state again. Thus, an AC-driving operation is performed.

Such an operation of holding the data signal Dj, a display operation of performing display according to the held voltage, and a display refresh operation are performed in the first mode on the individual sub-pixels 120*b* and 120*c*. Thus, the gradation display of one pixel is performed according to the ratio among the areas of the sub-pixels.

Next, an operation of the sub-pixel 120*a* in the second mode is described hereinbelow. In this case, all the scanning signals supplied to the writing scanning lines are at an active level. Conversely, all the data signals supplied to the digital data line 114 are at the non-active level. Thus, correspondingly to the sub-pixel 120*a* among the sub-pixels of the pixel 120 in question, which corresponds to the ith row and the j-th, the voltage level at one of the electrodes of the capacitance Cm-a is an L-level, as shown in FIG. 7(*a*). Thus, the switch 1202 always turns off.

On the other hand, in the first case of the second mode, voltage signals, whose levels are determined according to the gradation levels, are supplied in line sequence by the first data line driving circuit 180 to the analog data line 115. Alternatively, in the second case of the second mode, such voltage signals are supplied thereto in point sequence by the second data line driving circuit 190. Thus, such voltage signals are supplied thereto in one of these manners. Thus, at the sub-pixel 120*a*, the scanning signal Yci-a to be supplied to the display scanning line 112 is at the active level. When the switch 1203 turns on, the data signal Aj to be supplied to the analog data line 115 is directly written to the sub-pixel electrode 1218.

Incidentally, in the second mode, all scanning signals Yci-a, Yci-b, and Yci-c to be respectively supplied to three display scanning lines 112 become simultaneously at the active level. Thus, at the three sub-pixels 120*a*, 120*b*, and 120*c* constituting one pixel 120, the data signals Aj to be supplied to the analog data line 115 are written in common to the sub-pixel electrode 1218. Consequently, the three sub-pixels have an equal density. Thus, when a set of these sub-pixels is regarded as one pixel, the gradation display of the pixel, whose level corresponds to this density, is performed.

<Details of Scanning Line Driving Circuit>

Next, the details of the scanning line driving circuit 130 that supplies scanning signals to the display scanning line 112 and the writing scanning line 113 are described hereinbelow.

First, the shift register 132 is constructed by connecting (3m+2) stages, whose number is larger than the number of rows of sub-pixels by 2, each constituted by a latch circuit that shifts a pulse signal according to a predetermined clock signal. Incidentally, among pulse signals outputted from the stages of the latch circuits, pulse signals Ys0-*c*, Ys1-*a*, Ys1-*b*, and Ys2-*a* are outputted correspondingly to five rows, that is, (0-c)th, (1-a)th, (1-b)th, (1-c)th, and (2-a)th rows so that the durations of consecutive two pulse signals overlap with each other by a half of the period, in which the pulse signals have an active level, (that is, a half the cycle of the clock signal), as illustrated in of FIGS. 9(*a*) and 9(*b*). The sub-pixel corresponding to the (0-c)th row is a virtual or dummy one, and thus is not actually present, or does not contribute to, the actual display.

Furthermore, the detailed configuration of the scanning signal selector 134 is described hereinbelow. FIG. 8 is a circuit diagram illustrating the configuration of the signal selector 134. As shown in FIG. 8, an OR-gate 1341 and an AND gate 1342 are generally provided in such a way as to correspond to (i-b)-th and (i-c)th rows, respectively. Between these gates, the OR-gate 1341 outputs a logical OR signal representing the logical OR of signals Ysi-b and Ysi-c outputted from the latch circuits (that is, the latch circuits of the shift register 132) corresponding to the rows. Further, the AND-gate 1342 outputs a signal representing the logical AND of the logical OR signal outputted from the corresponding OR-gate 1341 and a signal Mode as a signal Modi corresponding to the pixel 120 at an ith row.

Moreover, an AND-gate 1343 is provided correspondingly to each row and outputs a signal representing the logical AND of pulse signals outputted from the adjacent latch circuits of the shift register 132. Among output signals of each of the AND-gate 1343, generally, logical AND signals outputted therefrom respectively corresponding to (i-a)th, (i-b)th, and (i-c)th rows are denoted by reference characters Ypi-a, Ypi-b, and Ypi-c, respectively.

Further, an OR-gate 1344 is provided correspondingly to each of the writing scanning lines 113, and operative to output a signal representing the logical OR of the logical AND signal, which is outputted from the corresponding AND-gate 1343, and the signal Mode as a scanning line signal to be supplied to the corresponding writing scanning line 113. The scanning signal actually outputted to the writing scanning line 113 is sent thereto through an AND-gate 152 of the enable circuit 150. Furthermore, as will be described below, the scanning signal Y0-*c* corresponding to the virtual (0-c)th row is adapted to be supplied only to the VLC selector 140 corresponding to the first row.

On the other hand, an OR-gate 1345 is provided correspondingly to each of the display scanning lines 112. Moreover, switches 1346 and 1347 and an inverter 1348 are provided correspondingly to an (i-a)th row. Among these, the switch 1346 is interposed between a power supply line, the voltage of which is at a lower logical level (that is, the L-level) side, and one of input terminals of the OR-gate 1345 corresponding to the (i-a)th row. Further, the switch 1346 turns on when the signal Mode is at an H-level. Furthermore, a switch 1347 is interposed between an output line of the AND gate 1343 corresponding to the immediately preceding row, namely, an ((i-1)-c)th row and one of input terminals of the OR-gate 1345 corresponding to the (i-a)th row. Further, the switch 1347 turns on when a signal obtained by inverting the signal Mode is at an H-level (that is, when the signal Mode is at the L-level).

Moreover, to one of the input terminals of the OR-gate 1345 corresponding to the (i-c)th row, a logical AND signal outputted from the AND-gate 1343 corresponding to the immediately preceding row, namely, the (i-b)th row, is supplied. Similarly, to one of the input terminals of the OR-gate 1345 corresponding to the (i-b)th row, a logical AND signal outputted from the AND-gate 1343 corresponding to the immediately preceding row, namely, the (i-a)th row, is supplied. On the other hand, to the other input terminal of each of the OR-gates 1345 respectively corresponding to the (i-a)th, (i-b)th, and (i-c)th rows, the logical AND signal Modi outputted from the AND-gate 1342 corresponding to these rows, are supplied. Further, the logical OR signal of the OR-gate 1345 is outputted to the corresponding display scanning line 112 as a scanning signal.

With such a configuration, in the first mode in which the signal Mode is at the L-level, the logical AND signal outputted from the AND-gate 1343 passes through the OR-gate 1344 without being processed, and is then directly outputted as the scanning signal corresponding to the writing scanning line 113. On the other hand, the AND gate 1342 is closed and the switch 1346 turns off and the switch 1347 turns on, the logical AND signal from the AND gate 1343 of the preceding low passes through the OR-gate 1345 and is then directly outputted as the scanning signal corresponding to the display scanning line 112.

Therefore, in the first mode, first, pulse signals Ys0-*c*, Ys1-*a*, Ys1-*b*, Ys1-*c*, Ys2-*a*, . . . , are outputted from adjacent latch circuits in the shift register 132 as illustrated in FIG. 9(*a*). Then, second, overlapping portions of these signals are obtained by the AND-gate 1343 as logical AND signals Yp0-*c*, Yp1-*a*, Yp0-*b*, Yp1-*c*, . . . . Third, these logical AND signals are outputted as scanning signals Y0-*c*, Y1-*a*, Y1-*b*, Y1-*c*, . . . , without being changed, and also outputted as scanning signals Yc1-*a*, Yc1-*b*, Yc1-*c*, Yc2-*a*, . . . , to be supplied to the just succeeding display scanning line 112.

That is, in the first mode, when it is assumed that the writing scanning line 113 corresponding to each row is paired with the display scanning line 112 corresponding to the just succeeding row, scanning signals, whose active periods do not overlap with each other, are supplied to each of pairs of such paired scanning lines from the top to the bottom, as viewed in the figures, in sequence.

On the other hand, in the second mode in which the signal Mode is at an H-level, the logical OR signal outputted from the OR-gate 1344 is at the H-level. Thus, all the scanning signals supplied to the writing scanning line 113 are always at the H-level. Further, the AND-gate 1342 is enabled, so that the logical AND signal Modi outputted therefrom depends upon the output of the OR-gate 1341. Incidentally, the OR-gate 1341 is at the H-level in a time period in which, among signals outputted from the latch circuits of the shift register 132, generally, the signal Ysi-b or Ysi-c outputted from the latch circuits corresponding to the (i-b)th or (i-c)th row is at the active level. That is, assuming that the apparatus is in the first mode, the scanning signal supplied to the display scanning line 112 corresponding to the ith row, which is counted in pixel units, that is, to the (i-a)th, (i-b)th and (i-c)th rows, which are counted in sub-pixel units, would be at the active level. Furthermore, the time period in which the signal outputted from the OR-gate 1341 is at the H-level, output signals of three corresponding OR-gates 1344 are at the H-level. Thus, the scanning signals supplied to the corresponding display scanning signals 112 are at the H-level that is common thereto.

Therefore, in the second mode, as illustrated in FIG. 9(*b*), first, pulse signals Ys0-*c*, Ys1-*a*, Ys1-*b*, Ys1-*c*, Ys2-*a* are outputted from the latch circuits consecutively disposed in the shift register 132. Then, second, the overlapping portions between the pairs of the consecutive signals are obtained by the AND-gate 1343 as the logical AND signals Yp0-*c*, Yp1-*a*, Yp1-*b*, Yp1-*c*, . . . , similarly as in the case of the first mode. However, third, the scanning signals Y0-*c*, Y1-*a*, Y1-*b*, . . . , Y1-*c*, . . . , to be supplied to the writing scanning line 113 are outputted in such a way as to always have the H-level. Moreover, only in the time period, in which pulse signals Ysi-b or Ysi-c outputted by the latch circuits are at the H-level, the scanning signals Yci-a, Yci-b, Yci-c to be supplied to the display scanning lines 112 corresponding to the (i-a)th, (i-b)th and (i-c)th rows are at the common H-level.

That is, in the second mode, the scanning signals, whose active time periods do not overlap with one another, are supplied to the display scanning lines 112 each selected every three thereof, that is, at intervals of the number of sub-pixels constituting one pixel from the top to the bottom, as viewed in FIG. 9(*b*), in sequence. Incidentally, in the second mode, the length of the time period, in which the scanning signal is at the active level, is equal to that of the time period in which the pulse signals Ysi-b or Ysi-c are at the H-level, and thus three times the length of the active period in the first mode.

<Details of VLC Selector>

Next, the details of the VLC selector 140 are described hereinbelow. FIG. 10 is a circuit diagram illustrating the configuration of the VLC selectors 140. Incidentally, the VLC selectors 140 illustrated in FIG. 10 correspond to the (1-a)th, (1-b)th, and (1-c)th rows, respectively, and are of the same configuration. Thus, the VLC selector 140 corresponding to the (1-a)th row is described hereinbelow by way of example.

A switch 1412 shown in FIG. 10 is adapted to turn on when the scanning signal Y1-*a* outputted by the scanning line driving circuit 130 correspondingly to the corresponding row are at the active level (that is, at the H-level). The switch 1412 has a terminal connected to the signal line to which a signal FIELD is supplied. On the other hand, the other terminal of this switch 1412 is connected to a terminal of the capacitance 1422, and to a control input terminal of the switch 1414 and to an input terminal of an inverter 1424.

Among these elements, the capacitance 1422 has the other terminal grounded to the power supply line, the voltage of which is at the lower logical level side. Further, the output terminal of the inverter 1424 is connected to the control input terminal of the switch 1416. Furthermore, a terminal of the switch 1414 is connected to the power supply line for the voltage signal Vbk(+). Further, a terminal of the switch 1416 is connected to the power supply line for the voltage signal Vbk(−). The other terminals of both of these switches are connected in common to a terminal of the switch 1413.

The switches 1414 and 1416 turn on when the voltage level at the control input terminal thereof is the H-level. The control input terminals of both of these switches are respectively connected to the input terminal and output terminal of the inverter 1424. Thus, each of both the switches turns on and off exclusively from each other. That is, one of the voltages Vbk(+) and Vbk(−) is selected according to the voltage held at a terminal of the capacitance 1422 and supplied to a terminal of the switch 1443.

On the other hand, the AND-gate 1432 is operative to obtain a logical AND signal representing the logical AND of the scanning signal Y0-*c*, which corresponds to the just preceding row, namely, the (0-c)th row, and a signal obtained by causing the inverter 1424 to invert the signal Mode, and then supply the obtained logical AND signal to the control input terminal of the switch 1441 and to the control input terminal of the switch 1443 through the inverter 1434. Attention is now focused on the VLC selector 140, so that the scanning signal Y0-*c* corresponding to the writing scanning line 113, which corresponds to virtual (0-c)th row, is supplied to the AND-gate 1432. However, each of the VLC selectors 140 respectively corresponding to the second row or later corresponds to the writing scanning line 113 corresponding to the immediately preceding row. Moreover, the scanning signal to be supplied to the AND-gate 152 in the enable circuit 150 is supplied to the AND-gate 1432.

Further, a terminal of the switch 1441 is connected to the power supply line for the voltage signal Vwt, while the other terminal of each of the switches 1441 and 1443 is connected in common to the signal line 118. The switches 1441 and 1443 are adapted to turn on when the voltage level at the control input terminal thereof is an H-level. However, the control input terminals of both the switches 1441 and 1443 are connected to the input terminal and the output terminal of the inverter 1434. Thus, both the switches 1441 and 1443 turn on and off exclusively from each other. That is, one of the voltage signals Vwt, or Vbk(+) or Vbk(−)is selected according to the level of the logical AND signal of the AND-gate 1432, and then the selected voltage signal is supplied to the signal line 118 as the voltage signal VLC1-a selected by this VLC selector 140.

The signal FIELD is adapted so that the logical level thereof is inverted every horizontal scanning time period (that is, the time period required to select three display scanning lines 112) in the first mode in which the signal Mode is at the L-level, as illustrated in FIG. 11(*a*), and that the logical level thereof is inverted in one horizontal scanning period time 1H the same three display scanning lines 112 are selected after the lapse of one vertical scanning time 1V.

Meanwhile, when the scanning signal Y0-*c* corresponding to the just preceding row is at the active level (that is, the H-level) is at the active level (or the H-level) in the first mode in the circuit of such a configuration, the logical AND signal outputted from the AND-gate 1432 becomes at an H-level. Thus, the switch 1441 turns on, while the switch 1443 turns off. Consequently, the voltage signal Vwt is outputted as the signal VLC1-*a*.

Further, when the scanning signal Y1-*a* corresponding to the row in question is at the H-level in a horizontal scanning period in which the signal level of the signal FIELD becomes the H-level, the switch 1412 turns on. In contrast, the switch 1414 turns on according to the H level of the signal FIELD, the switch 1416 turns off. Furthermore, the logical AND signal outputted from the AND-gate 1432 is at the L-level. Thus, the switch 1441 turns off, while the switch 1443 turns on. Consequently, the voltage signal Vbk(+) is outputted as the signal VLC1-*a*.

Thereafter, even when the scanning signal Y1-*a* is at the L-level, or when the switch 1412 turns off, the voltage of the H-level of the signal FIELD is held at a terminal of the capacitance 1422. Thus, the state, in which the voltage signal Vbk(+) is outputted as the signal VLC1-*a*, is maintained until the signal level of the scanning signal Y0-*c* corresponding to the just preceding row becomes an H-level again after the lapse of one vertical scanning period 1V.

Further, when the scanning signal Y0-*c* corresponding to the just preceding row becomes the H-level again, the voltage signal Vwt is selected. Subsequently, when the scanning signal Y1-*a* corresponding to the row in question becomes the H-level, the signal FIELD becomes at the L-level this time. Thus, the voltage signal Vbk(−) is selected, and then outputted as the signal VLC1-*a*.

Such an operation is performed on each of 3 m VLC selectors 140, the number of which is equal to a total number of rows counted in sub-pixel units. That is, when in the first mode, the voltage signal selected by the VLC selector 140 corresponding to a row is a voltage signal Vwt when the scanning signal corresponding to the writing scanning line 113, which corresponds to the just preceding row, becomes an H level. Subsequently, when the scanning signal corresponding to the writing scanning line 113, which corresponds to the same row, is at the H-level, and the signal FIELD is also at the H-level, the voltage signal Vbk(+) is kept selected until the scanning signal corresponding to the just preceding row becomes at the H-level after the lapse of 1 vertical scanning period 1V. If the signal FIELD is at the L level, the voltage signal Vbk(−) is kept selected until the scanning signal corresponding to the just preceding row becomes the H level after the lapse of 1 vertical scanning period 1V.

As described above, in the first mode, the scanning signal to be supplied to the display scanning line 112 corresponding to a certain row is outputted at a moment preceding a moment, at which the scanning signal to be supplied to the writing scanning line corresponding to the same row is outputted, by a time period that corresponds to (⅓) of 1 horizontal scanning period. Thus, a time period, in which the scanning signal corresponding to the writing scanning line 113 for the just preceding row becomes at the H-level in the VLC selector 140 corresponding to a certain row, is a time period in which the scanning signal corresponding to the display scanning line 112 for the same row as the certain row corresponding to the selector 140 becomes at the H-level.

Therefore, a time period, in which the voltage signal Vwt is selected by the VLC selector 140 corresponding to a certain row in the first mode, is a time period in which the scanning signal supplied to the display scanning line 112 corresponding to the same row as the certain row corresponding to the selector 140 becomes at the H-level. As illustrated in FIG. 5(*b*) and FIG. 6(*b*), in this time period, a display refresh operation is performed at the sub-pixel. Further, in a time period, in which the voltage signal Vwt is not selected by the VLC selector 140 in the first mode, a display operation is performed according to the voltage held at the capacitance Cm at the sub-pixel, as illustrated in FIG. 5(*c*) and FIG. 6(*c*).

At that time, the polarity of the black display voltage signal to be applied to the signal line 118 in a non-selection time period is inverted every lapse of 1 vertical scanning time period 1V. Thus, AC-driving of the sub-pixel is performed without changing the data signal Dj to be supplied to the digital data line 114. Furthermore, in the first mode, the logical value designated by the signal FIELD is inverted every lapse of one horizontal scanning time period 1H in which three rows respectively corresponding to three sub-pixels 120*a*, 120*b*, and 120*c* of one pixel 120 are selected. Thus, the writing polarity is inverted every row that is counted in pixel units.

On the other hand, in the second mode in which the signal Mode is at an H-level, the signal FIELD is always at the H-level, as illustrated in FIG. 11(*b*). Thus, the switch 1414 turns off, while the switch 1416 turns on. Further, the logical AND signal outputted from the AND-gate 1432 is always at an L-level, so that the switch 1441 turns off and the switch 1416 turns on. Therefore, in the second mode, the voltage signal selected by each of the VLC selectors 140 is the voltage signal Vbk(−), regardless of the level of the scanning signal, as illustrated in FIG. 11(*b*). In the second mode, the scanning signals corresponding to the writing scanning line 113 are always at the H level, which is as described in the details of the scanning line driving circuit 130.

<Details of Data Line Driving Circuit>

Next, the first data line driving circuit 180, which operates in the first mode and in the first case of the second mode, and the second data line driving circuit 190, which operates in the second mode, of this mode are described hereinbelow.

<Details of First Data Line Driving Circuit>

First, the detailed configuration of the first data line driving circuit 180 is described hereinbelow with reference to FIG. 12.

As shown in FIG. 12, a shift register 183 is operative to output signals Xs1, Xs2, . . . , Xsn, whose active level periods do not overlap with one another in one horizontal scanning time period 1H, in sequence. The shift register 183 of this configuration is similar to the shift register 132 of the scanning line driving circuit 130. However, the number of latch circuits of the shift register 183 is (n+1). Moreover, in the register 183, an AND-gate for obtaining the logical AND of signals outputted from the latch circuits thereof is actually provided, similarly as, for example, the AND-gate 1343 (see FIG. 8) of the scanning signal selector 132. The description and illustration of this are omitted herein.

Meanwhile, n switches 184, the number of which is equal to the number of columns of pixels 120, are provided at the output side of the shift register 183. Further, generally, when the signal xsj corresponding to a j-th column is at the active level (that is, the H-level), the corresponding switch 184 turns on. Then, the sampling of the gradation data (Data) to be supplied in sequence through the image signal line 181 is performed.

Incidentally, the gradation data (Data) designates the density level of the pixel 120, and is externally supplied with predetermined timing. For convenience of description, bits of the gradation data are respectively denoted in sequence by reference characters a, b, c, and d from the least significant bit (LSB). As described above, the electro-optical apparatus according to this embodiment performs 8-level gradation display in the first mode. However, in the first case of the second mode, the apparatus performs 16-level gradation display. Thus, in the first mode, the gradation data (Data) is constituted by three bits a, b, and c. However, in the first case of the second mode, the gradation data (Data) is constituted by four bits a, b, c, and d. Therefore, in any mode, the bit a is the least significant bit of the gradation data. The bit d is not used in the first mode.

Further, the first latch circuit 185 includes n latch elements 1-LATCH-1, 1-LATCH-2, . . . , 1-LATCH-n. Moreover, generally, the latch element 1-LATCH-j corresponding to a j-th column holds the gradation data (Data), which are sampled by the corresponding switch 184, for a time period, which is equal in length to 1 horizontal scanning time period 1H, when the signal Xsj is at the active level.

Further, the second latch circuit 186 includes n unit circuits 1860. In the first mode, the second latch circuit 186 sequentially shifts bits a, b, and c of the latched 3-bit gradation data in one horizontal scanning time period 1H and outputs signal representing resultant data to the digital data line 114 as a data signal Dj. In contrast, in the second mode, the circuit 186 outputs a voltage signal obtained by performing the digital-to-analog conversion of latched 4-bit gradation data to the analog data line 115 in one horizontal scanning time period 1H as a data signal Aj. Incidentally, the detailed configuration of the unit circuit 1860 will be described below.

Furthermore, n switches 188 are provided in a one-to-one relationship correspondingly to the analog data lines 115. These switches turn on when the signal obtained by inverting the level of a signal DDS in the inverter 187 is at an H-level (that is, when the signal DDS is at the L-level). Therefore, when the signal DDS is at the H-level, that is, in the first case of the second mode, the analog data lines 115 are electrically disconnected from the second latch circuit 186.

<Detailed Configuration of Unit Circuit>

Further, the general detailed configuration of one unit circuit 1860, which corresponds to the j-th column, of the second latch circuit 186 is described hereinbelow by way of example. FIG. 13 is a schematic illustrating the configuration of this unit circuit.

As shown in FIG. 13, a latch element designated by reference numeral 1861 and reference character 2-LATCH-j is operative to latch bits a, b, c, and d of the gradation data, which is latched by the latch element 1-LATCH-j of the first latch circuit 185, again according to a latch pulse LP outputted in the beginning of one horizontal scanning time period 1H.

Among gradation data latched by this latch element 2-LATCH-j, the bits a, b, and c are supplied to the latch elements a-LATCH denoted by 1862, b-LATCH designated by 1863, and c-LATCH denoted by 1864. Incidentally, the latch elements a-LATCH denoted by 1862, b-LATCH designated by 1863, and c-LATCH denoted by 1864 shift the bits a, b, and c in this order and output the shifted data according to clock signals CLKs outputted every time period obtained by trisecting one horizontal scanning time period. Thus, a first circuit is constituted by these latch elements.

Further, in the first mode in which the signal Mode is at an L level, the selector 1867 selects signals outputted from the latch elements a-LATCH denoted by 1862, b-LATCH designated by 1863, and c-LATCH denoted by 1864. Furthermore, in the second mode in which the signal Mode is at an H-level, the selector 1867 selects the power supply line, which provides a lower logical level voltage (namely, an L-level) and outputs the selected data as the data signal Dj. Therefore, data represented by the data signal Dj to be supplied to the digital data line 114 corresponding to the j-th column in the first mode are the bits a, b, and c of the gradation data, which respectively correspond to three time periods obtained by dividing one horizontal scanning time period. In contrast, the data, which is represented by the data signal Dj to be supplied thereto in the second mode, is always at an L-level.

Meanwhile, all the bits a, b, c and d of the gradation data, which are latched again by the latch element 2-LATCH-j are supplied to a DA converter (that is, a second circuit) 1865. The DA converter 1865 outputs voltage signals, which are obtained by performing the digital-to-analog conversion of the 4-bit data, with timing determined by the latch pulses LP. At this digital-to-analog conversion, the DA converter 1865 inverts the polarity of the voltage signal with respect to the voltage applied to the counter electrode 108, every horizontal scanning period 1H and every vertical scanning period 1V and outputs a resultant signal.

Furthermore, the selector 1868 selects a white display voltage signal Vwt in the first mode in which the signal Mode is at the L-level. Further, in the second mode in which the signal Mode is at the H-level, the selector 1868 selects a voltage signal outputted from the DA converter 1865. Thus, the data signal Aj corresponding to the j-th column is the voltage signal Vwt in the first mode. Furthermore, in the second mode, the data signal Aj corresponding to the j-th column is the voltage signal outputted by the DA converter 1865. The switch 188 (see FIG. 12) is provided correspondingly to each of the analog data lines 115. Thus, in the second case of the second mode, the voltage signals obtained by the DA converter 1865 are not supplied to the analog data lines 115.

The latch elements a-LATCH denoted by 1862, b-LATCH designated by 1863, and c-LATCH denoted by 1864 are used only in the first mode. Further, the DA converter 1865 is used only in the first case of the second mode. Thus, needless to say, the apparatus may be configured so that only one of the group of the latch elements and this DA converter is operated and the other is stopped according to the signal Mode.

<Details of Second Data Line Driving Circuit>

Next, the details of the second data line driving circuit 190 enabled to operate in the second case of the second mode are described hereinbelow. FIG. 14 is a schematic illustrating the detailed configuration of the second data line driving circuit 190.

As illustrated in FIG. 14, the shift register 193 outputs signals Xt1, Xt2, . . . , Xtn, whose active level periods do not overlap with one another, in sequence in one horizontal scanning time period 1H. Incidentally, the configuration of this shift register 193 is the same as that of the shift register 182 (see FIG. 12) of the first data line driving circuit 180.

Meanwhile, a terminal of the switch 195 is connected to each of outputs of the shift register 193. These switches 195 are adapted to perform the sampling of analog image signals Vid supplied to the image signal lines 191 when the correcting output signals of the shift register 193 are at an active level.

Furthermore, the other terminal of each of these switches 195 is connected to a corresponding terminal of each of the switches 197. Moreover, the other terminal of each of the switches 197 is connected to the corresponding analog data line 115. These switches 197 turn on when the signal DDS are at an H-level, that is, in the second case of the second mode.

Therefore, the image signals Vid sampled by the switches 195 are supplied to the analog data lines 115. In other cases, the analog data lines 195 are electrically disconnected from the switches 195.

<Operation of Electro-optical Apparatus>

Hereinafter, an operation of the electro-optical apparatus according to this embodiment in the first mode, in which the signal Mode is at the L-level, and another operation thereof in the second mode, in which the signal Mode is at the H-level, are described.

<First Mode>

First, an operation of the apparatus in the fist mode is described hereinbelow. As described above, in the first mode, the signal DDS is at the L-level. Thus, all of the switches 188 illustrated in FIG. 12 turn on. In contrast, all of the switches 197 shown in FIG. 14 turn off. Further, in the unit circuit 1850 corresponding to each of columns shown in FIG. 13, the selector 1867 selects one of outputs of the latch circuit. Further, the selector 1868 selects the white display voltage signal Vwt. Therefore, in the first mode, the bits outputted from the latch circuit are supplied to the digital data lines 114. Further, the voltage signals Vwt are supplied to the analog data lines 115 as the data signals A1 to An.

FIG. 15 is a timing chart illustrating an operation in the first mode. As illustrated in FIG. 15, first, the gradation data (Data) (3 bits) corresponding to the pixels 120, which correspond to (a first row, a first column), (a first row, a second column), . . . , (a first row, an nth column), are supplied in sequence through the image signal lines 181. Subsequently, the gradation data (Data) corresponding to the pixels 120, which correspond to (a second row, a first column), (a second row, a second column), . . . , (a second row, an nth column), are supplied in sequence therethrough. Then, similarly, the gradation data (Data) corresponding to the pixels 120, which correspond to (an m-th row, a first column), (an m-th row, a second column), . . . , (an m-th row, an n-th column), are supplied in sequence therethrough.

When the signal Xs1 outputted from the shift register 183 (see FIG. 12) with timing, with which the gradation data (Data) at the pixel 120 corresponding to the first row and the first column, among these data are supplied, are at the active level, this gradation data (Data) is latched by the first latch element 1-LATCH-1 on the first column in the first latch circuit 185. Subsequently, when the signal Xs2 are at the active level with timing with which the gradation data (Data) at the pixel 120, which corresponds to the first row and the second column, are supplied, the gradation data (Data) is latched by the latch element 1-LATCH-2 in the first latch circuit 185. Then, similarly, the gradation data (Data) at the pixel 120, which corresponds to the first row and an nth column, is latched by the latch element 1-LATCH-n corresponding to the nth column in the first latch circuit 185. Consequently, the gradation data (Data) at the pixels 120 corresponding to the first row are latched by the latch elements 1-LATCH-1, 1-LATCH-2, . . . , 1-LATCH-n, respectively.

Subsequently, when the latch pulse LP is outputted, the gradation data (Data) respectively latched by the latch elements 1-LATCH-1, 1-LATCH-2, . . . , 1-LATCH-n are simultaneously and respectively latched by the latch elements 2-LATCH-1, 2-LATCH-2, . . . , 2-LATCH-n.

Then, the bits a, b, and c among the latched data (Data) are transferred by the latch elements a-LATCH denoted by 1862, b-LATCH designated by 1863, and c-LATCH denoted by 1864 according to the clock signals CLKs. Consequently, the data signal D1 becomes at the level designating the bit a among the gradation data at the pixel corresponding to the first row and the first column in the first one of three time periods, into which one horizontal scanning period 1H is trisected. Further, in the second one of the three time periods, the data signal D1 becomes at the level designating the bit b. Furthermore, in the third one of the three time periods, the data signal D1 becomes at the level designating the bit c. This is the same with other data signals D2, D3, . . . , Dn.

Further, in the first time period, the scanning signal G1-*a* is at the active level. Thus, the least significant bit a designating On or Off of the sub-pixel placed on the (1-a)th row is held at the capacitance Cm-a of the sub-pixel 120*a*. Moreover, in the second time period, the scanning signal G1-*b* is at the active level. Thus, the least significant bit b designating On or Off of the sub-pixel placed on the (1-b)th row is held at the capacitance Cm-b of the sub-pixel 120*b*. Furthermore, in the third time period, the scanning signal G1-*c* is at the active level. Thus, the least significant bit c designating On or Off of the sub-pixel placed on the (1-c)th row is held at the capacitance Cm-c of the sub-pixel 120*c*. Then, similar operations are performed on the sub-pixels placed on the (2-a)th, (2-b)th, (2-c)th, . . . , (m-a)th, (m-b)th, (m-c)th rows in line sequence.

Further, upon completion of writing the bit designating On or Off of each of the sub-pixels to the capacitance corresponding thereto in such a manner, a display refresh operation, and a display operation are performed correspondingly to each of the sub-bits according to the corresponding bit, as above described. Particularly, as illustrated in FIG. 16, when the scanning signal Yci-a supplied to the display scanning line 112 corresponding to the (i-a)th row is at the H-level, the display refresh operations illustrated in FIG. 5(*b*) or FIG. 6(*b*) are performed at all the sub-pixels 120*a* corresponding to this row. Furthermore, at the sub-pixels corresponding to other rows, display operations illustrated in FIG. 5(*c*) or in FIG. 6(*c*) are performed. Subsequently, as illustrated in FIG. 16, when the scanning signal Yci-b supplied to the display scanning line 112 corresponding to the (i-b)th row is at the H-level, the display refresh operations are performed at all the sub-pixels 120*b* corresponding to this row. Then, when the scanning signal Yci-c supplied to the display scanning line 112 corresponding to the (i-c)th row is at the H-level, the display refresh operations are performed at all the sub-pixels 120*c* corresponding to this row. That is, in each of the three time periods obtained by trisecting one horizontal scanning time period 1H, the sub-pixels corresponding to one row are selected and display refresh operations are performed in sequence. On the other hand, display operations are performed at the sub-pixels corresponding to rows that are not selected.

Incidentally, the ratio among the areas of the sub-pixels 120*a*, 120*b*, and 120*c* is set at about 1:2:4 according to the bits a, b, and c. Thus, when the sub-pixels 120*a*, 120*b*, and 120*c* are turned on or off according to these bits, the area gradation display is performed.

Further, as illustrated in FIG. 16 (or FIG. 11), the voltage signals Vbk(+) and Vbk(−) are alternately selected every vertical scanning time period 1V as the voltage signals VLCi-a, VLCi-b, and VLCi-c supplied through three signal lines 118 corresponding to the ith row during the display operation. Thus, the voltage signal to be applied to the sub-pixel electrode 1218 corresponding to the sub-pixel, on which black display should be performed, is polarity-inverted with respect to the potential at the counter electrode 108 even when the bit held at the capacitance Cm is not rewritten. Thus, AC-driving operations are performed. For example, in the case that a bit corresponding to the H-level, by which black display is performed, is written to the capacitance Cm-a at the sub-pixel 120*a* corresponding to the intersection between the (i-a)th row and the j-th column and the capacitance Cm-c at the sub-pixel 120*c* corresponding to the intersection between the (i-c)th row and the j-th column, the voltages Pix(i,j)-a and Pix(i,j)-c to be applied to these liquid crystal capacitances are polarity-inverted every vertical scanning time period 1V, as illustrated in FIG. 16.

On the other hand, when the white display voltage signal Vwt, which is equal to the voltage applied to the counter electrode 108, is applied to the sub-pixel electrode 1218 corresponding to the sub-pixel, at which white display should be performed, by performing a display refresh operation, the switches 1202 and 1203 turn off during display operations thereafter performed. Therefore, the white display state is maintained. Thus, there is no need to rewrite the bit held in the capacitance Cm corresponding to the sub-pixel at which white display should be performed. For example, in the case that a bit corresponding to the L-level, at which white display should be performed, is written to the capacitance Cm-b of the sub-pixel 120*b* corresponding to the intersection between the (i-b)-th row and the j-th column, the voltage represented by the voltage signal Vwt is maintained as the voltage Pix(i,j)-b to be applied to this liquid crystal capacitance, as illustrated in FIG. 16.

Therefore, when the on-state or off-state of the sub-pixels 120*a*, 120*b*, and 120*c* are not changed, no variation in the voltage occurs on the corresponding writing scanning line 113 by setting the level of the signal ENB at an L-level with timing with which the corresponding writing scanning line 113 is selected. Thus, no power is consumed by the capacity load of the writing scanning line 113. Further, the switch 1201 (see FIG. 4) does not perform a switching operation. Hence, there is no power consumption due to the switching operation of this switch. Consequently, the power consumption of the apparatus can be reduced.

Furthermore, the signal FIELD is level-inverted every horizontal scanning time period. Thus, the voltage signal applied to the signal line 118 in a non-selection time period is polarity-inverted every row counted in pixel units (that is, every three rows counted in sub-pixel units), as illustrated in FIG. 11. Therefore, the writing polarity in the display operation is inverted every row, so that flicker is prevented in the first mode.

<Second Mode>

Further, an operation in the second mode, in which the level of the signal Mode is an H-level, is described hereinbelow by describing the first and second cases thereof.

<First Case>

First, the first case, in which the signal Mode is at the L-level and the signal DDS is at the L-level, is described hereunder. In this case, all the switches 188 illustrated in FIG. 12 turn on. Conversely, all the switches 197 illustrated in FIG. 14 turn off.

Moreover, the selector 1867 in the unit circuit 1850 corresponding to each column illustrated in FIG. 13 selects the signal whose signal level is the L-level. Furthermore, the selector 1868 selects an output of the DA converter 1865. Thus, the signals, whose signal levels are L-levels, are supplied to all the digital data lines 114 as the data signals D1 to Dn. In contrast, the voltage signals obtained by the DA converter 1865 are supplied to the analog data lines 115 as the data signals A1 to An.

Meanwhile, FIG. 17 is a timing chart illustrating an operation in the first case of the second mode. The first case of the second mode differs from the second mode in that the gradation data (Data) supplied through the image signal lines 181 is 4-bit data. Further, as illustrated in this chart, operations of the latch elements 2-LATCH-1, 2-LATCH-2, . . . , 2-LATCH-n in the second latch circuit 186 are similar to those of the latch elements in the first mode. Thus, an operation to be performed upon completion of the operation of these latch elements is described hereinbelow.

First, in the first case, the bits a, b, and c of the gradation data are latched by the latch elements 2-LATCH-1, 2-LATCH-2, . . . , 2-LATCH-n undergoing the digital-to-analog conversion performed by the DA converter 1865 corresponding to each column and then outputted with timing with which the latch pulse LP is supplied thereto.

When the scanning signals Yc1-*a*, Yc1-*b*, Yc1-*c* are at the active level, the switches 1203 (see FIG. 4) turn on in the sub-pixels 120*a*, 120*b*, 120*c* respectively corresponding to three rows and constituting the pixel 120, which corresponds to the first row and the j-th column. Thus, the voltage signals outputted from the DA converter 1865 and supplied through the analog data lines 115 are written to the liquid crystal capacitance. Thereafter, even when the scanning signals Yc1-*a*, Yc1-*b*, Yc1-*c* are at the non-active level, so that the switches 1203 turn off, the voltage level of the voltage signals written to the capacitance is held by the liquid crystal capacitance and the storage capacitances Cs-a, Cs-b, Cs-c. This operation is performed on the pixels that are placed on the first row and correspond to the columns other than the j-th column.

Furthermore, thereafter, similar operations are performed on the pixels 120 corresponding to the second row, the third row, . . . , the m-th row in an inline-sequence manner. Thus, in the fist case of the second mode, the sub-pixels 120*a*, 120*b*, 120*c* of each single pixel 120 undergo the gradation display to be performed according to the held voltage so that the sub-pixels have an equal density level.

For example, when the scanning signals Yc1-*a*, Yc1-*b*, and Yc1-*c* are at the active level, all the voltages Pix(i,j)-a, Pix(i,j)-b, and Pix(i,j)-c to be applied to the liquid crystal capacitances respectively corresponding to the three sub-pixels of the pixel 120, which corresponds to the ith row and the j-th column, are the data voltage Aj supplied to the analog data line 115 corresponding to the j-th column. Thereafter, this voltage is maintained at the capacitances as the common writing voltage, even when the scanning signals Yc1-*a*, Yc1-*b*, and Yc1-*c* are at the non-active level.

Furthermore, at the digital-to-analog conversion, the DA converter 1865 inverts the polarity of the voltage signal with respect to the voltage applied to the counter electrode 108 at each supply of the latch pulse P (that is, every horizontal scanning time period 1H). Thus, the writing polarity is inverted every pixel of each row. Further, at the digital-to-analog conversion, the DA converter 1865 inverts the polarity of the data signal Aj corresponding to the same row after the lapse of one vertical scanning time period. Thus, the DC voltage component to be applied to the liquid crystal capacitance, which is measured with respect to the voltage applied to the counter electrode 108, is 0 (see FIG. 19). Thus, AC driving operations are conducted.

<Second Case>

Next, the second case of the second mode, in which the signal Mode is at the L-level and the signal DDS is at the H-level, is described hereinbelow.

In this case, the scanning signals to be supplied to 3 display signal lines 113 corresponding to the same row become at the active level in sequence every horizontal scanning time period, similarly as in the first case. Thus, in the first horizontal scanning time period 1H, the scanning signals Yc1-*a*; , Yc1-*b*, and Yc1-*c* are at the active level in sequence. At the sub-pixels 120*a*, 120*b*, 120*c* placed on the three rows, the switches 1203 (see FIG. 4) turn on.

Meanwhile, in the second case, all the switches 188 illustrated in FIG. 12 turn off. Conversely, all the switches 197 illustrated in FIG. 14 turn on. Furthermore, in the unit circuits 1850 corresponding to each column shown in FIG. 13, the selector 1867 selects the signal whose signal level is the L-level. Thus, the signals having the L-level are supplied to all the digital data lines 114 as the data signals. Conversely, an image signal Vid, obtained by the second data line driving circuit 190, is supplied to each of the analog data lines 115.

Particularly, as illustrated in FIG. 18, in the first horizontal scanning time period 1H, analog image signals Vid corresponding to the pixels 120, which correspond to(a first row, a first column), (a first row, a second column), . . . , (a first row, an nth column), are supplied in sequence from an external circuit through the image signal lines 191. Incidentally, when the signal Xt1 outputted from the shift register 193 (see FIG. 14) with timing with which the pixel 120 corresponding to the first row and the first column is supplied with a corresponding image signal Vid, the corresponding switch 195 turns on, so that the image signal Vid is sampled on the analog data lines 115 corresponding to the first column.

In this single horizontal scanning time period, the scanning signals Yc1-*a*, Yc1-*b*, Yc1-*c* are at the active level, the image signal Vid sampled on the analog data line 115, corresponding to the first column, is written in common to the three sub-pixel electrodes 1218 corresponding to the pixel 120 corresponding to the first row and the first column (that is, the sub-pixel corresponding to the (1-a)th row and the second column, the sub-pixel corresponding to the (1-b)th row and the second column, and the sub-pixel corresponding to the (1-c)th row and the second column).

Subsequently, when the image signal Vid corresponding to the pixel 120, which corresponds to the first row and the second column, is supplied thereto, the signal Xt2 is at the active level. Thus, the image signal Vid is sampled on the analog data line 115 corresponding to the second column, and written in common to the three sub-pixel electrodes 1218 corresponding to the pixel 120 corresponding to the first row and the second column (that is, the sub-pixel corresponding to the (1-a)th row and the second column, the sub-pixel corresponding to the (1-b)th row and the second column, and the sub-pixel corresponding to the (1-c)th row and the second column).

Further, in the first horizontal scanning time period, such an operation is similarly performed until the image signals corresponding to the first row and the nth column are supplied. Thus, an operation of writing image data of the pixels corresponding to the first row (that is, the sub-pixels corresponding to the (1-a)th, (1-b)th and (1-c)th rows) is completed.

Moreover, in the second horizontal scanning time period, the scanning signals Yc2-*a*, Yc2-*b*, Yc2-*c* become at the active level. Further, the analog image signal Vid corresponding to the pixels 120, which correspond to (the second row, the first column), (the second row, the second column), and (the second row, the nth column), are supplied in sequence from an external circuit through the image signal lines 191. Thus, an operation of writing image data of the pixels corresponding to the second row (that is, the sub-pixels corresponding to the (2-a)th, (2-b)th and (2-c)th rows) is completed. Furthermore, thereafter, similar operations are performed until an operation of writing image data of the pixels corresponding to the m-th row (that is, the sub-pixels corresponding to the (m-a)-th, (m-b)-th and (m-c)-th rows) is completed.

The writing polarity in the second case is determined depending upon the cycle at which the external circuit inverts the polarity of the image signal Vid and outputs the polarity-inverted image signal. Further, the waveform of the voltage actually applied to the liquid crystal capacitance is similar to that of the voltage in the first case, which is illustrated in FIG. 19.

<Summary>

Thus, in the electro-optical apparatus according to the embodiment, in the first mode, the area gradation display is performed by turning on or off the sub-pixels 120*a*, 120*b*, 120*c* according to the gradation data (Data). Moreover, it is sufficient to rewrite the data of the sub-pixels, whose on-states or off-states are changed. Thus, high-quality display with little display unevenness is realized with low power consumption.

Further, although each pixel is divided into three sub-pixels, the gradation display is performed in the second mode so that the sub-pixels have an equal density level. This enables multi-level gradation display using gradation levels, the number of which is equal to or larger than the number of the sub-pixels of each single pixel. In the first case of the second mode, the gradation data (Data) is processed as digital data in a portion up to the first data line driving circuit 180, which is provided in a stage that is just preceding the pixels 120. Consequently, display unevenness due to ununiform characteristics of a preprocessing circuit can be suppressed. Moreover, in the second case of the second mode, the gradation display is performed by using image signals Vid obtained from analog signals received from the external circuit. Consequently, extremely enriched gradation display is realized.

Therefore, according to the electro-optical apparatus according to this embodiment, both high-quality display with little display unevenness and multi-gradation display can be achieved by selecting one of the modes and one of the cases of the second modes according to the circumstances.

Incidentally, the case of displaying a still picture, and the case of displaying characters and line drawings, and the case, in which the remaining amount of charge in a battery is small, and the case, in which the apparatus is in a standby mode, are cited as examples of the case that the first mode should be selected. Further, the case of displaying an animation, and the case of displaying a painting and a natural picture, and the case of needing the multi-level gradation display are cited as examples of the case that the second mode should be selected. The selection of one of the modes and the cases of the second modes may be performed by an external decision unit adapted to automatically select the mode or the case in view of such various conditions. Alternatively, a user may manually select the mode or the case by manipulating an additional switch. Furthermore, similarly, the selection of one of the first and second cases of the second mode may be automatically or manually performed according to the load exerted on the external circuit and the required number of gradation levels.

Further, in the aforementioned embodiment, the description is given by focusing attention on the display operation. However, when attention is focused on an inspection operation, the invention has an advantage that can be understood from the following description. That is, if the apparatus does not have the second data line driving circuit 190, defects in the sub-pixels cannot be inspected by reading voltage signals, which are once outputted, though a common path because the DA converter 1865 is provided at the output side of the analog data line 115 in the first data line driving circuit 180.

In contrast, the embodiment of the invention can check the presence of defects in all the sub-pixels, because of the facts that the voltage signals are once written by the first data line driving circuit 180 to the storage capacitance of the sub-pixel before stuck to the opposing substrate 102 (that is, before the liquid crystal capacitances are formed), and that thereafter other voltage signals are read in point sequence as inspection signals RCs (see FIG. 14) and compared with the written voltage signals.

<Other Embodiments>

Although one pixel 120 is constituted by the sub-pixels 120*a*, 120*b*, 120*c* arranged in the Y-direction in the aforementioned embodiment, as illustrated in FIG. 3, the invention is not limited thereto. As shown in FIG. 20, one pixel 120 may be constituted by the sub-pixels 120*a*, 120*b*, 120*c* arranged in the X-direction. In this configuration, each of bits a, b, and c of the gradation data (Data) are supplied to the corresponding data lines 114 in a horizontal scanning period 1H in the first mode. In contrast, in the second mode, a common voltage signal is supplied to three analog data lines 115 in a horizontal scanning period 1H.

Further, although the sub-pixels 120*a*, 120*b*, and 120*c* are configured in the embodiment, as illustrated in FIG. 4, the switches 1201, 1202, and 1203 are actually constituted by, for example, n-channel TFTs (Thin Film Transistors) 1231, 1232, and 1232, which use poly-silicon layers as active layers, as shown in FIG. 21. Moreover, these switches may be constituted by p-channel TFTs, complementary TFTs or amorphous silicon TFTs. Incidentally, in the case that the switch 1203 is constituted by the n-channel or p-channel TFT, it is necessary to preliminarily offset the voltage signal Vwt corresponding to the white display in such a manner as to cancel a phenomenon called "field through" in the TFT. However, in the case that the switches are constituted by the complementary TFTs, such an offset is unnecessary. Furthermore, it is preferable that the active devices of the scanning line driving circuit 130, the scanning signal selector 140, the first data line driving circuit 180, and the second data line driving circuit 190 are constituted by devices formed in the same process as that for producing this switch.

On the other hand, in the aforementioned embodiment, 8-gradation-level display is performed in the first mode by using 3-bit gradation data. Further, in the first case of the second mode, 16-gradation-level display is performed in the first mode by using 4-bit gradation data. However, the invention is not limited thereto. That is, the apparatus may be adapted so that the gradation display using the equal number of gradation levels is performed, or that multi-level gradation display using gradation levels of the number, which is larger than 16, is performed. Furthermore, needless to say, color display may be performed by further making pixels correspond to R-color (red), G-color (green), and B-color (blue).

Furthermore, although a glass substrate is used as the device substrate 101 in the embodiment, the device substrate 101 may be formed by applying SOI (Silicon On Insulator) techniques and forming a silicon monolithic crystal film on an insulating substrate made of sapphire, quartz, or glass and then making various devices thereon. Alternatively, the apparatus may be adapted so that a silicon substrate is used as the device substrate 101, and that various devices are formed on this substrate. In such a case, a field-effect transistor can be used as the first and second switches. This facilitates a high-speed operation. When the device substrate 101 does not have transparency, it is necessary to use the liquid crystal device as being of the reflection type by forming the pixel electrodes 118 from aluminum and also forming a separate reflection layer.

Moreover, although the aforementioned embodiment uses TN liquid crystals, the apparatus may use bistable liquid crystals, such as BTN (Bi-stable Twisted Nematic) liquid crystals and ferroelectric liquid crystals, which have memory capability, and polymer dispersion liquid crystals, and GH (Guest-Host) liquid crystals obtained by dissolving a dye (namely, a guest), which has anisotropy in absorption in the directions of molecule long and short axes of visible light, in liquid crystal (namely, a host) having a certain molecular disposition and by establishing the parallel orientation of dye molecules and liquid crystal molecules.

Further, the apparatus may employ a vertical orientation structure (namely, a homeotropic orientation structure), in which the liquid crystal molecules are oriented in a direction perpendicular to both the substrates when no voltage is applied to the liquid crystals, and in which the liquid crystal molecules are oriented in a direction parallel to both the substrates when a voltage is applied to the liquid crystals. Alternatively, the apparatus may employ a parallel (or horizontal) orientation structure (namely, a homogeneous orientation structure), in which the liquid crystal molecules are oriented in a direction parallel to both the substrates when no voltage is applied to the liquid crystals, and in which the liquid crystal molecules are oriented in a direction perpendicular to both the substrates when a voltage is applied to the liquid crystals. Thus, the invention can be applied to the apparatus employing various kinds of liquid crystal molecules and orientations thereof.

Additionally, the invention can be applied to various kinds of electro-optical apparatuses, which perform display by utilizing electro-optical effects obtained by using electroluminescense (EL), plasma light emission and fluorescence due to electron emission, in addition to liquid crystal display devices. At that time, EL, mirror devices, gas, or phosphor may be used as the electro-optical material. In the case of using EL as the electro-optical material, EL is present between the sub-pixel electrode 1218 and the counter electrode, which are constituted by transparent conductive films, on the device substrate 101. Thus, the opposing substrate 102, which is needed by the liquid crystal device, becomes unnecessary. In this way, the invention can be applied to all the electro-optical apparatuses that have the aforementioned configuration or the configuration similar thereto.

<Electronic Equipment>

Next, several examples of application of the electro-optical apparatus according to the aforementioned embodiment are described hereinbelow.

<1: Projector>

First, a projector employing the aforementioned electro-optical apparatus as a light valve is described hereinbelow. FIG. 22 is a plan view illustrating the configuration of this projector. As shown in FIG. 22, in the projector 2100, a lamp unit 2102 constituted by a white light source, such as a halogen lamp, is provided. Projection light irradiated from this lamp unit 2102 is separated into three primaries, namely, R, G, B light rays by three mirrors 2106 and two dichroic mirrors 2108 disposed therein. The separated light rays are incident upon light valves 100R, 100G, and 100B, corresponding to the primary colors, respectively. The configuration of each of the light valves 100R, 100B, and 100G is the same as that of the aforementioned electro-optical apparatus 100. The light valves 100R, 100G, and 100B are respectively driven by R, G, and B primary color signals supplied from an image signal processing circuit (not shown). Further, the B-color light has a long optical path, as compared with the R-color light and the G-color light. Thus, to prevent the loss of the b-color light, this color light is led through a relay lens system consisting of an incidence lens 2122, a relay lens 2123 and an output lens 2124.

Then, the light rays modulated by the light valves 100R, 100G, and 100B are incident upon a dichroic prism 2112 from three directions. This dichroic prism 2112 deflects the R-color light ray and the B-color light ray by 90 degrees. On the other hand, the G-color light ray travels rectilinearly. Thus, a color image is synthesized from component images displayed in such colors. Then, a color image is projected on the screen 2120 through a projection lens 2114.

Light rays corresponding to R, G, and B primary colors are incident upon the light valves 100R, 100G, and 100B, respectively. Thus, color filters do not need to be provided, similarly as in the aforementioned case. Although the transmission images of the light valves 100R and 100B are projected after reflected by the dichroic mirror 2112, the transmission image of the light valve 100G is directly projected. Thus, the image displayed by each of the light valves 100R and 100B is laterally flipped with respect to the image displayed by the light valve 100G.

<2: Mobile Computer>

Next, an example of application of the aforementioned electro-optical apparatus 100 is described hereinbelow. FIG. 23 is a perspective view illustrating the configuration of this personal computer. As shown in FIG. 23, the computer 2200 has a main unit portion 2204 provided with a keyboard 2202, and also has an electro-optical apparatus 100. Incidentally, a backlight unit (not shown) that enhances the visibility is provided on this rear surface.

<3: Hand Portable Telephone Set>

Furthermore, an example of application of the aforementioned electro-optical apparatus 100 to a display portion of a hand portable telephone set is described hereinbelow. FIG. 24 is a perspective view illustrating the configuration of this portable telephone set. In FIG. 24, the hand portable telephone set 2300 has a receiver 2304, a transmitter 2306, and the aforementioned liquid crystal panel 100 in addition to a plurality of operating buttons 2302. In the case of the hand portable telephone set of such a configuration, it is preferable that the fist mode is selected when a call is waited for, and that in contrast, when a user talks over the telephone, the second mode is selected. A backlight unit (not shown) for enhancing visibility is provided in the rear face portion of this liquid crystal panel 100.

In addition to the electronic equipment described by referring to FIGS. 22, 23 to 24, a liquid crystal television set, a view finder or monitor direct view video tape recorder, a car navigation system, a pager, an electronic notepad, an electric calculator, a word processor, a workstation, a television telephone set, a POS terminal, a digital still camera, and various devices each having a touch panel are cited as examples of the electronic equipment. Additionally, needless to say, the electro-optical apparatus according to the embodiment or application of the invention can be applied to such various kinds of electronic equipment.

As above described, the invention enables the selection of display that is suitable for various conditions by switching between display performed according to the area gradation method and display performed according to a multi-level gradation display using gradation levels, the number of which is more than that determined by the number of division of one pixel into sub-pixels.

What is claimed is:

1. A method of driving an electro-optical apparatus, which includes a set of sub-pixels that adjoin one another and that are disposed correspondingly to intersections between scanning lines, which are formed in a direction of a row, and paired data lines, which include first and second data lines formed in a direction of a column, as one pixel, comprising the steps of:

turning each of said sub-pixels of said one pixel on or off in a first predetermined mode according to corresponding bits of gradation data, which designate a gradation level of said pixel and are supplied through a corresponding first data line;

supplying a voltage signal, which corresponds to the gradation level of said pixel, through a corresponding second data line; and applying the voltage signal in a second predetermined mode in common to said sub-pixels of said one pixel.

2. The method of driving an electro-optical apparatus according to claim 1, further including the steps of holding a corresponding bit of the gradation data with holding devices of said electro-optical apparatus, provided correspondingly to each of said sub-pixels, turning said sub-pixels off once in the first mode regardless of data represented by the corresponding bit held in said holding devices, and thereafter, turning said sub-pixels on or off according to the bits of the gradation data, which are preliminarily held in said holding devices.

3. The method of driving an electro-optical apparatus according to claim 1, further including the steps of selecting said second data lines in a predetermined order in the second mode correspondingly to said sub-pixel corresponding to a selected row, and applying a voltage signal to said selected second data line.

4. The method of driving an electro-optical apparatus according to claim 1, further including the step of simultaneously applying voltage signals through said second data lines to said sub-pixels corresponding to said selected rows in the second mode.

5. A driving circuit for an electro-optical apparatus, adapted to drive a set of sub-pixels that adjoin to one another in a direction of a column and that are disposed correspondingly to intersections between scanning lines, which are formed in a direction of a row, and paired data lines, which include first and second data lines formed in a direction of a column, as one pixel, said driving circuit comprising:

a scanning line driving circuit that outputs, in a first predetermined mode, a scanning signal, which selects said scanning lines line by line, to each of said scanning lines and outputs, in a second predetermined mode, a scanning signal, which selects said scanning lines every lines of the number of said sub-pixels of one pixel, to each of said scanning lines; and a data line driving circuit that outputs, in the first predetermined mode, a corresponding bit of gradation data representing a gradation level of a pixel including said sub-pixel, which corresponds to the intersection corresponding to said scanning line selected by said scanning line driving circuit, to a corresponding first data line and outputs, in the second mode, a voltage signal corresponding to a gradation level of the pixel to corresponding second data lines that corresponds to the intersection corresponding to the said sub-pixels grouped as one pixel.

6. The driving circuit for an electro-optical apparatus according to claim 5, said data line driving circuit including:

a first driving circuit; and a second driving circuit, said first driving circuit outputting a bit to said first data line in the first mode, and one of said first driving circuit and said second driving circuit outputting a voltage signal to said second data line.

7. The driving circuit for an electro-optical apparatus according to claim 6, said first driving circuit including:

a first circuit that outputs, in the first mode, a corresponding bit of gradation data of a pixel including one of sub-pixels, which is placed on said selected scanning line to said first data line corresponding to said one of sub-pixels; and a second circuit that outputs, when said second driving circuit outputs a voltage signal only to said second data line in the second mode, data obtained by performing a digital-to-analog conversion on gradation data of a pixel including one of said sub-pixels, which is placed on said selected scanning line, to said second data line corresponding to said one of said sub-pixels.

8. The driving circuit for an electro-optical apparatus according to claim 6, said second driving circuit being a circuit that samples and outputs, when said first driving circuit outputs a voltage signal only to said second data line in the second mode, voltage signals, whose levels correspond to a gradation level of a pixel including one of said sub-pixels, which is placed on said selected scanning line, in sequence to said second data line corresponding to said one of said sub-pixels.

9. An electro-optical apparatus, adapted to drive a set of sub-pixels that adjoin to one another in a direction of a column and that are disposed correspondingly to intersections between scanning lines, which are formed in a direction of a row, and paired data lines, which include first and second data lines formed in a direction of a column, as one pixel, said apparatus comprising:

a scanning line driving circuit that outputs, in a first predetermined mode, a scanning signal, which selects said scanning lines line by line, to each of said scanning lines and that outputs, in a second predetermined mode, a scanning signal, which selects said scanning lines every lines of the number of said sub-pixels of one pixel, to each of said scanning lines; and a data line driving circuit that outputs, in the first predetermined mode, a corresponding bit of gradation data representing a gradation level of a pixel including said sub-pixel, which corresponds to the intersection corresponding to said scanning line selected by said scanning line driving circuit, to a corresponding first data line and that outputs, in the second mode, a voltage signal corresponding to a gradation level of the pixel to corresponding second data lines that corresponds to the intersection corresponding to the said sub-pixels grouped as one pixel.

10. The electro-optical apparatus according to claim 9, said sub-pixel including:

a first switch, adapted to turn on or off in the first mode according to a signal supplied to a write control line provided correspondingly to each of said scanning lines;

a holding device that holds, when said first switch turns on in the first mode, data according to a bit supplied to a corresponding one of said first data lines;

a second switch that selects, after a signal, which turning off said sub-pixel, is selected in the first mode regardless of data held in said holding device, a signal causing said sub-pixel to turn on or off according to the data held in said holding device;

a third switch, adapted to turn on or off according to a scanning signal supplied to a corresponding one of said scanning lines in the second mode, that samples voltage signals supplied to said corresponding second data line; and a sub-pixel electrode to which a signal selected by said second or third switch is applied.

11. The electro-optical apparatus according to claim 10, further including a storage capacitance that holds a voltage applied to a corresponding sub-pixel electrode.

12. The electro-optical apparatus according to claim 11, said storage capacitance having an end connected to said sub-pixel electrode and also having the other end connected to a potentiostatic signal line.

13. The electro-optical apparatus according to claim 11, capacity of said storage capacitance being determined according to the area of a corresponding sub-pixel electrode.

14. A piece of electronic equipment, comprising:

said electro-optical apparatus according to claim 9.

* * * * *